US009395653B2

(12) United States Patent
Maeyama et al.

(10) Patent No.: US 9,395,653 B2
(45) Date of Patent: Jul. 19, 2016

(54) WET-TYPE DEVELOPING DEVICE AND WET-TYPE IMAGE FORMING APPARATUS

(71) Applicant: Konica Minolta, Inc., Chiyoda-ku (JP)

(72) Inventors: Takeshi Maeyama, Ikeda (JP); Kunitomo Sasaki, Takatsuki (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/478,400

(22) Filed: Sep. 5, 2014

(65) Prior Publication Data

US 2015/0078784 A1 Mar. 19, 2015

(30) Foreign Application Priority Data

Sep. 17, 2013 (JP) ..... 2013-191916
Jul. 18, 2014 (JP) ..... 2014-147307

(51) Int. Cl.

| | |
|---|---|
| ***G03G 15/11*** | (2006.01) |
| ***G03G 15/10*** | (2006.01) |
| ***G03G 21/00*** | (2006.01) |
| ***G03G 15/08*** | (2006.01) |

(52) U.S. Cl.

CPC ..... *G03G 15/11* (2013.01); *G03G 15/0815* (2013.01); *G03G 15/104* (2013.01); *G03G 21/0088* (2013.01)

(58) Field of Classification Search

CPC ..... G03G 15/11; G03G 21/0088; G03G 2221/0084; G03G 15/0266; G03G 15/065

See application file for complete search history.

(56) References Cited

U.S. PATENT DOCUMENTS 8,538,299 B2 * 9/2013 Izawa ..... G03G 15/0815 399/239
2005/0078984 A1 4/2005 Fujita et al.
2011/0249990 A1 * 10/2011 Izawa ..... G03G 15/104 399/238
2012/0148279 A1 * 6/2012 Soda ..... G03G 15/105 399/55
2014/0016976 A1 * 1/2014 Horemans ..... G03G 15/11 399/348
2014/0301755 A1 * 10/2014 Horemans ..... G03G 15/11 399/240
2015/0063871 A1 * 3/2015 Horemans ..... G03G 15/104 399/238

(Continued)

FOREIGN PATENT DOCUMENTS

JP 2005-121816 A 5/2005
JP 2006-30719 A 2/2006
JP 2012-103644 A 5/2012

OTHER PUBLICATIONS

Machine Translation of JP 2006-030719. Takeuchi et al. Feb. 2, 2006.*

*Primary Examiner* — David Gray
*Assistant Examiner* — Carla Therrien
(74) *Attorney, Agent, or Firm* — Buchanan Ingersoll & Rooney PC

(57) ABSTRACT

The present wet-type developing device includes: a developer carrier for carrying a wet-type developer, which contains a charged toner particle and carrier liquid, and supplying the wet-type developer to an image carrier on which an electrostatic latent image is formed; a charge neutralizing unit for neutralizing a charge of the toner particle contained in the wet-type developer remaining on the developer carrier after supplying the wet-type developer to the image carrier; a dispersing unit for dispersing the toner particle in the carrier liquid by acting on the toner particle contained in the wet-type developer neutralized in charge by the charge neutralizing unit; and a removing unit for removing, from the developer carrier, the wet-type developer containing the toner particle dispersed by the dispersing unit.

17 Claims, 13 Drawing Sheets

(56) References Cited

U.S. PATENT DOCUMENTS

2015/0168863 A1* 6/2015 Op de Beeck ..... G03G 9/135
430/114

2015/0248080 A1* 9/2015 Hirai ..... G03G 15/11
399/237

2015/0370197 A1* 12/2015 Hirai ..... G03G 15/11
399/240

* cited by examiner

FIG.22

| | CHARGE NEUTRALIZING UNIT | DISPERSING UNIT | BIAS | RESULT OF ACCUMULATION OF TONER |
|---|---|---|---|---|
| COMPARATIVE EXAMPLE 1 | NOT PROVIDED | NOT PROVIDED | — | C |
| COMPARATIVE EXAMPLE 2 | NOT PROVIDED | ROLLER | SAME POTENTIAL | C |
| COMPARATIVE EXAMPLE 3 | NOT PROVIDED | ROLLER | AC BIAS | C |
| COMPARATIVE EXAMPLE 4 | PROVIDED | NOT PROVIDED | — | B |
| COMPARATIVE EXAMPLE 5 | PROVIDED (BEFORE DISPERSING UNIT) | ROLLER (AFTER CHARGE NEUTRALIZING) | SAME POTENTIAL | B |
| COMPARATIVE EXAMPLE 6 | PROVIDED (AFTER DISPERSING UNIT) | ROLLER (BEFORE CHARGE NEUTRALIZING UNIT) | AC BIAS | B |
| COMPARATIVE EXAMPLE 7 | NOT PROVIDED | ULTRASONIC WAVE VIBRATION PROVIDING MEMBER | — | C |
| COMPARATIVE EXAMPLE 8 | PROVIDED (AFTER DISPERSING UNIT) | ULTRASONIC WAVE VIBRATION PROVIDING MEMBER (BEFORE CHARGE NEUTRALIZING UNIT) | — | B |
| EXAMPLE 1 | PROVIDED (BEFORE DISPERSING UNIT) | ROLLER (AFTER CHARGE NEUTRALIZING) | AC BIAS | A |
| EXAMPLE 2 | PROVIDED (BEFORE DISPERSING UNIT) | ULTRASONIC WAVE VIBRATION PROVIDING MEMBER (AFTER CHARGE NEUTRALIZING UNIT) | — | A |

WET-TYPE DEVELOPING DEVICE AND WET-TYPE IMAGE FORMING APPARATUS

This application is based on Japanese Patent Applications Nos. 2013-191916 and 2014-147307 filed with the Japan Patent Office on Sep. 17, 2013 and on Jul. 18, 2014, respectively, the entire content of which is hereby incorporated by reference.

BACKGROUND OF THE INVENTION

1. Field of the Invention

The present invention relates to a wet-type developing device employing a wet-type developer containing toner particles and carrier liquid, and a wet-type image forming apparatus including the wet-type developing device.

2. Description of the Related Art

In recent years, various types of wet-type image forming apparatuses have been proposed which employ a wet-type electrophotographic method to achieve printing of high-quality images on demand. In the wet-type electrophotographic method, image formation is performed using liquid toner (wet-type developer) containing carrier liquid and toner particles.

This type of wet-type image forming apparatus includes a wet-type developing device, in which an electrostatic latent image is developed by supplying a wet-type developer carried by the developer carrier to an image carrier having the electrostatic latent image formed thereon. The wet-type developer remaining on the developer carrier after the development is removed from the surface of the developer carrier for next development by a removing unit such as a cleaning blade.

Japanese Laid-Open Patent Publication No. 2006-030719 (document 1) is an exemplary document disclosing such a wet-type developing device configured to remove the wet-type developer remaining on the developer carrier.

The wet-type developing device disclosed in document 1 includes: the developer carrier for carrying the wet-type developer and developing the latent image formed on the image carrier; the removing unit for removing the wet-type developer remaining on the developer carrier after the development; and removal assisting means, disposed at an upstream side relative to the removing unit, for reducing cohesive force of the toner particles contained in the wet-type developer remaining on the developer carrier.

With such a configuration, the toner particles contained in the remaining wet-type developer after the development can be suppressed from being caught between the cleaning blade serving as the removing unit and the developer carrier, thereby removing the wet-type developer without damaging the surface of the developer carrier.

Meanwhile, although the configuration of removing the wet-type developer from the developer carrier is not disclosed, Japanese Laid-Open Patent Publication No. 2005-121816 (document 2) is an exemplary document disclosing a wet-type image forming apparatus configured such that a toner image formed by developing an electrostatic latent image using a wet-type developer is transferred to a transfer member and then remaining wet-type developer is removed from an image carrier after the transfer for the sake of next transfer.

The wet-type image forming apparatus disclosed in document 2 includes: the image carrier for carrying the toner image formed by supplying the wet-type developer containing toner particles and carrier liquid and for conveying the toner image to a transfer position; a removing unit, disposed at a downstream side relative to the transfer position, for removing remaining wet-type developer from the image carrier after the transfer; and a dispersing unit, disposed between the transfer position and a removal position for the removing unit, for dispersing the toner particles contained in the wet-type developer on the image carrier.

With such a configuration, the toner particles contained in the wet-type developer remaining on the image carrier can be suppressed from being firmly fixed to the image carrier, thereby suppressing the toner particles after the transfer from adversely affecting the image to result in deteriorated image quality.

Here, regarding the wet-type developing device disclosed in document 1, it is described that before the wet-type developer remaining on the developer carrier is removed using the removing unit, the removal assisting means performs one of the following operations: neutralization of charges in the toner layer; formation of an AC electric field; and application of external force mechanically to the toner layer.

Only with the neutralization of charges in the toner layer on the developer carrier by the removal assisting means before removing the toner particles using the removing unit, the charges in the toner layer are distributed in the form of two layers, thus failing to cancel the electrostatic binding force of the developer carrier on the toner layer.

Also, only with the generation of AC electric field by the removal assisting means instead of the neutralization of charges, the electrostatic binding force of the developer carrier on the toner layer cannot be canceled sufficiently.

Also, only with the application of mechanical external force to the toner particles by the removal assisting means instead of the neutralization of charges and the generation of AC electric field, the electrostatic binding force of the developer carrier on the toner layer cannot be canceled.

Accordingly, also in each of the cases, a part of the toner particles once separated from the developer carrier are adhered to the surface of the developer carrier again due to electrostatic force before being removed by the removing unit.

Hence, in the wet-type developing device disclosed in document 1, the electrostatic binding force cannot be canceled sufficiently, with the result that the toner particles cannot be dispersed sufficiently in the wet-type developer and the toner particles are accordingly accumulated on the removing unit, disadvantageously.

Document 2 discloses the configuration of removing the wet-type developer remaining on the image carrier, but it is difficult to directly apply this configuration to the removing unit for the developer carrier, which is different from the image carrier.

Even if this configuration is applied to the removing unit for the developer carrier, the electrostatic binding force of the developer carrier on the toner layer cannot be sufficiently canceled only with the generation of AC electric field by the dispersing unit. Moreover, when the AC electric field is generated while the charges held by the toner layer are not sufficiently canceled, the toner particles are adhered to the dispersing unit, with the result that a sufficient dispersing effect cannot be obtained.

Thus, even when the configuration of removing the wet-type developer from the image carrier as disclosed in document 2 can be applied to the configuration of removing the wet-type developer from the developer carrier, the electrostatic binding force of the developer carrier on the toner layer cannot be canceled sufficiently, with the result that the toner particles are accumulated on the removing unit, disadvantageously.

As described above, in the wet-type developing device, when removing the remaining wet-type developer from the developer carrier after the development using the cleaning blade serving as the removing unit, the toner particles may be accumulated at an abutment portion at which the cleaning blade is in abutment with the developer carrier.

The accumulation of toner particles takes place due to a difference between the viscosity of the wet-type developer located near the surface of the developer carrier and the viscosity of the wet-type developer located away from the surface of the developer carrier in the wet-type developer remaining on the developer carrier.

Specifically, in the wet-type developer located near the surface of the developer carrier, toner particles are aggregated to exist locally in the form of a layer near the surface of the developer carrier, so that the toner density of the wet-type developer becomes very high. This leads to a very high viscosity of the wet-type developer located near the surface of the developer carrier.

On the other hand, the wet-type developer located away from the surface of the developer carrier includes a large amount of carrier liquid, resulting in a low toner density of the wet-type developer. This leads to a low viscosity of the wet-type developer located away from the surface of the developer carrier.

The wet-type developer having the low viscosity flows over the wet-type developer having the high viscosity and is then drained. On the other hand, the wet-type developer having the high viscosity stays at the abutment portion of the cleaning blade, resulting in the accumulation of toner particles on the cleaning blade.

Once the toner particles are accumulated, more toner particles are accumulated due to the wet-type developer being continuously conveyed by the developer carrier, with the result that they cannot be recovered to a developer recovery tank.

The wet-type developer removed by the removing unit and recovered to the developer recovery tank is desirably conveyed to the developer tank again and used repeatedly for development for the purpose of cost reduction. However, when toner particles are accumulated, it becomes difficult to recover the toner particles and the accumulated toner particles need to be discarded during maintenance. This leads to increase in an amount of discarded toner particles, with the result that the toner particles cannot be efficiently reused, disadvantageously.

Moreover, when an excessive amount of toner particles are accumulated by repeatedly performing development, the accumulation of toner particles leads to contamination around the removing unit, resulting in deterioration of maintainability and image noise.

SUMMARY OF THE INVENTION

The present invention has been made in view of the above problems, and has an object to provide a wet-type developing device, by which toner particles contained in a wet-type developer remaining on a developer carrier after development can be suppressed from being accumulated on the removing unit, as well as a wet-type image forming apparatus including such a wet-type developing device.

A wet-type developing device according to the present invention includes: a developer carrier for carrying a wet-type developer, which contains a charged toner particle and carrier liquid, and supplying the wet-type developer to an image carrier on which an electrostatic latent image is formed; a charge neutralizing unit for neutralizing a charge of the toner particle contained in the wet-type developer remaining on the developer carrier after supplying the wet-type developer to the image carrier; a dispersing unit for dispersing the toner particle in the carrier liquid by acting on the toner particle contained in the wet-type developer neutralized in charge by the charge neutralizing unit; and a removing unit for removing, from the developer carrier, the wet-type developer containing the toner particle dispersed by the dispersing unit.

Preferably in the wet-type developing device according to the present invention, the charge neutralizing unit neutralizes the charge such that a polarity of a surface potential of a toner layer formed by a plurality of the toner particles adsorbed on a surface of the developer carrier becomes opposite to a normal charge polarity of the toner particle.

Preferably, the wet-type developing device according to the present invention further includes a charging unit for charging the toner particle before the developer carrier supplies the wet-type developer to the image carrier. In this case, preferably, an amount of neutralized charge of the toner particle by the charge neutralizing unit is equal to or less than an amount of charge provided to the toner particle by the charging unit.

Preferably, in the wet-type developing device according to the present invention, the dispersing unit includes a conductive member disposed to face the developer carrier such that an AC bias is applied between the developer carrier and the conductive member.

Preferably, in the wet-type developing device according to the present invention, the conductive member is disposed in contact with the wet-type developer neutralized in charge by the charge neutralizing unit.

Preferably in the wet-type developing device according to the present invention, the AC bias applied between the conductive member and the developer carrier has an average potential as large as a potential of the developer carrier.

Preferably in the wet-type developing device according to the present invention, the conductive member is disposed to be spaced away from the wet-type developer so as not to make contact with the wet-type developer neutralized in charge by the charge neutralizing unit.

Preferably in the wet-type developing device according to the present invention, the AC bias applied between the conductive member and the developer carrier has an average potential that attracts the toner particle from the developer carrier side to the conductive member side.

Preferably in the wet-type developing device according to the present invention, the dispersing unit includes a vibration providing member for providing ultrasonic vibration to the toner particle contained in the wet-type developer neutralized in charge by the charge neutralizing unit.

Preferably in the wet-type developing device according to the present invention, the dispersing unit includes a brush member for slidably making contact with the developer carrier so as to disperse the toner particle contained in the wet-type developer neutralized in charge by the charge neutralizing unit.

Preferably, the wet-type developing device according to the present invention further includes: a surface potential measuring unit, disposed at a downstream side relative to the dispersing unit and an upstream side relative to the removing unit in a rotation direction of the developer carrier, for measuring a surface potential on the developer carrier; and a control unit for controlling an amount of charge neutralized by the charge neutralizing unit, wherein the control unit controls the amount of charge neutralized by the charge neutralizing unit based on the surface potential on the developer carrier measured by the surface potential measuring unit.

Preferably, the wet-type developing device according to the present invention further includes a unit for applying a developing bias to the developer carrier, wherein the control unit controls the amount of charge neutralized by the charge neutralizing unit such that a value of the surface potential on the developer carrier becomes close to the developing bias.

Preferably in the wet-type developing device according to the present invention, the control unit controls the amount of charge neutralized by the charge neutralizing unit, in a start sequence.

Preferably, a wet-type image forming apparatus according to the present invention includes: the wet-type developing device recited in any one of the descriptions above; and a transfer unit for transferring, to a recording medium, a toner image formed on the image carrier by developing the electrostatic latent image by the wet-type developer.

Preferably in the wet-type image forming apparatus according to the present invention, a patch image for controlling an amount of charge neutralized by the charge neutralizing unit is formed on the image carrier, and the control unit controls the amount of charge neutralized by the charge neutralizing unit based on a surface potential on the developer carrier after developing the patch image onto the image carrier.

Preferably in the wet-type image forming apparatus according to the present invention, the patch image is formed in a region between a plurality of the toner images.

Preferably in the wet-type image forming apparatus according to the present invention, the patch image is formed in a region out of a range of the toner image.

Preferably in the wet-type image forming apparatus according to the present invention, the patch image is a dot half pattern.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 22 shows conditions and results of verification experiments conducted to verify an effect of the present invention.

DESCRIPTION OF THE PREFERRED EMBODIMENTS

Figure 1:
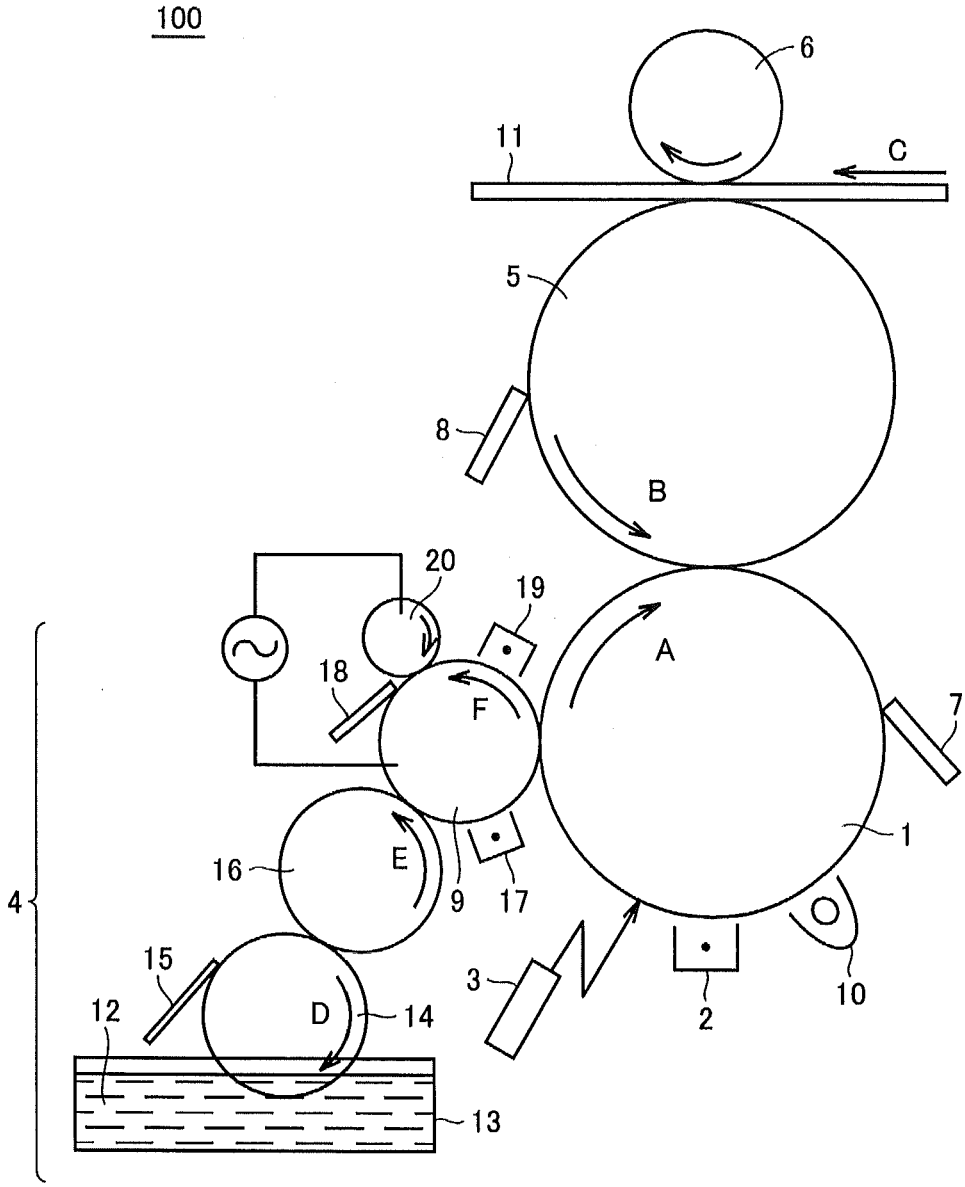
FIG. 1 is a schematic view showing an entire configuration of a wet-type image forming apparatus according to a first embodiment of the present invention.

The following describes embodiments and modifications of the present invention in detail with reference to figures. It should be noted that in the embodiments and modifications described below, the same or common portions are given the same reference characters in the figures and are not described repeatedly.

(First Embodiment)

(Entire Configuration and Operation of Wet-Type Image Forming Apparatus)

Referring to FIG. 1, the entire configuration of a wet-type image forming apparatus 100 according to the present embodiment will be described.

As shown in FIG. 1, wet-type image forming apparatus 100 according to the present embodiment includes: a photoconductor drum 1 serving as an image carrier; a charging device 2; an exposure device 3; a wet-type developing device 4; an intermediate transfer member 5 and a secondary transfer member 6 both serving as a transfer unit; an image carrier cleaning device 7; and an intermediate transfer member cleaning device 8.

Photoconductor drum 1 has a cylindrical shape with its surface provided with a photoconductor layer (not shown). Photoconductor drum 1 is driven to rotate in the direction of arrow A in FIG. 1. Around the outer circumference of photoconductor drum 1, charging device 2, exposure device 3, wet-type developing device 4, intermediate transfer member 5, and image carrier cleaning device 7 are sequentially disposed in the rotation direction (A direction) of photoconductor drum 1.

Charging device 2 charges the surface of photoconductor drum 1 to a predetermined potential. Exposure device 3 emits light to the surface of photoconductor drum 1 to decrease a charge level in the emitted region, thereby forming an electrostatic latent image. The electrostatic latent image formed on photoconductor drum 1 is developed by wet-type developing device 4. Specifically, a wet-type developer is conveyed to the development region of photoconductor drum 1 and toner particles contained in the wet-type developer are supplied to the electrostatic latent image on the surface of photoconductor drum 1, thereby forming a toner image.

In the development process, a developing bias voltage is applied from a power source (not shown) to developer carrier 9 of wet-type developing device 4 described below. According to an electric field generated due to a balance between the potential of the electrostatic latent image on photoconductor drum 1 and the potential of developer carrier 9, toner particles in the wet-type developer are electrostatically adsorbed to the electrostatic latent image portion of photoconductor drum 1, thereby developing the electrostatic latent image on photoconductor drum 1.

Intermediate transfer member 5 is disposed to face photoconductor drum 1, and is rotated in the direction of arrow B in the figure in contact with photoconductor drum 1. At a nip portion between intermediate transfer member 5 and photoconductor drum 1, primarily transfer from photoconductor drum 1 to intermediate transfer member 5 is performed.

In the primary transfer process, a transfer bias voltage is applied from the power source (not shown) to intermediate transfer member 5. Accordingly, an electric field is formed between intermediate transfer member 5 and photoconductor drum 1 in the primary transfer position, whereby the toner image on photoconductor drum 1 is electrostatically adsorbed to intermediate transfer member 5. As a result, the toner image on photoconductor drum 1 is transferred onto intermediate transfer member 5.

When the toner image on photoconductor drum 1 is transferred to intermediate transfer member 5, image carrier cleaning device 7 removes the remaining toner image from photoconductor drum 1 and the next image formation is performed. As required, an eraser lamp 10 is disposed between image carrier cleaning device 7 and charging device 2.

Intermediate transfer member 5 and secondary transfer member 6 are disposed to face each other with a recording medium 11, which serves as a recording material, being interposed therebetween. Intermediate transfer member 5 and secondary transfer member 6 are rotated in contact with each other with recording medium 11 being interposed therebetween. At a nip portion between intermediate transfer member 5 and secondary transfer member 6, secondary transfer from intermediate transfer member 5 to recording medium 11 is performed. Recording medium 11 is conveyed to the secondary transfer position in the direction of arrow C in the figure at the timing of secondary transfer.

In the secondary transfer process, a transfer bias voltage is applied to secondary transfer member 6 from the power source (not shown). Accordingly, an electric field is formed between intermediate transfer member 5 and secondary transfer member 6 to electrostatically adsorb the toner image from intermediate transfer member 5 onto recording medium 11 passing between intermediate transfer member 5 and secondary transfer member 6. As a result, the toner image on intermediate transfer member 5 is transferred onto recording medium 11.

When the toner image is transferred on recording medium 11, intermediate transfer member cleaning device 8 removes a remaining toner image from intermediate transfer member 5, and the next secondary transfer is performed. Recording medium 11 is then conveyed to a fixing device not shown in the figure, and the toner particles on recording medium 11 are heated and melted, thereby fixing the toner particles to recording medium 11.

It should be noted that FIG. 1 shows single-color wet-type image forming apparatus 100 employing one pair of photoconductor drum 1 and wet-type developing device 4, but the present invention is applicable also to a color image forming apparatus configured such that four pairs of photoconductor drums 1 and wet-type developing devices 4 are prepared in total, images of respective colors of CMYK (Cyan, Magenta, Yellow, Black) are formed, and the images are stacked on intermediate transfer member 5. Further, the present invention is applicable also to a direct transfer method in which intermediate transfer member 5 is omitted and the toner image is transferred directly from photoconductor drum 1 onto the recording medium. In addition, each of conventionally used electrophotographic process techniques can be combined with an appropriate configuration depending on a purpose of the image forming apparatus.

(Configuration of Wet-Type Developer)

The following describes the wet-type developer used for development. The wet-type developer is configured such that a high concentration of colored toner particles are dispersed in carrier liquid serving as a solvent. Additives, such as a dispersant and a charge control agent, may be appropriately selected and added to the wet-type developer.

As the carrier liquid, an insulative solvent is used. Each of the toner particles is mainly composed of a resin and a pigment or dye for coloring. The resin has a function of dispersing the pigment or dye uniformly in the resin as well as a function as a binder when being fixed to recording medium 11.

Any toner particles can be used without any particular limitation as long as the toner particles are generally used for wet-type developer in the electrophotographic method. Examples of the toner particle binding resin include a polystyrene resin, a styrene acrylic resin, an acrylic resin, a polyester resin, an epoxy resin, a polyamide resin, a polyimide resin, a polyurethane resin, and other thermoplastic resins. Plural ones of these resins may be mixed with each other and used. Also, a general, commercially available pigment and dye for coloring of toner particles can be used.

The toner particles appropriately have a volume mean particle size falling within a range of not less than 0.1 μm and not more than 5 μm. When the mean particle size of the toner particles is less than 0.1 μm, developability is greatly decreased. On the other hand, when the mean particle size is more than 5 μm, an image including a dot and a solid is deteriorated in quality. The volume mean particle size of the toner particles is further preferably in a range of not less than 1 μm and not more than 2 μm. When the mean particle size of the toner particles is not less than 1 μm, the cleaning characteristic becomes better. When the mean particle size of the toner particles is not more than 2 μm, a solid portion becomes stable in an image in terms of its uniformity.

The wet-type developer can be prepared based on a generally used method. For example, a binder resin and a pigment in a predetermined blending ratio are melted and mixed using a pressurizing kneader, a roller mill, or the like to disperse them uniformly, and then a resulting dispersion is pulverized using a jet mill, for example. By classifying resulting powders using, for example, an air classifier or the like, colored toner particles having a desired particle size can be obtained. The toner particles thus obtained are mixed with the insulative liquid serving as the carrier liquid in a predetermined blending ratio. By uniformly dispersing this mixture using dispersing means such as a ball mill, the wet-type developer can be obtained.

Preferably, a ratio of the mass of the toner particles to the mass of the wet-type developer is not less than 10% and not more than 50%. When the ratio of the mass of the toner particles to the mass of the wet-type developer is not less than 10%, the toner particles are less likely to settle, whereby the toner particles have high stability with time for long-term storage and an amount of wet-type developer required to obtain a desired image density can be reduced. Accordingly, when fixing the toner particles, a large amount of carrier liquid does not need to be dried, thereby preventing a large amount of vapors from being generated from the carrier liquid. When the ratio of the mass of the toner particles to the mass of the liquid developer is not more than 50%, the viscosity of the liquid developer becomes appropriate in value, resulting in favorable handling thereof during production.

(Configuration and Development Process of Wet-Type Developing Device)

As shown in FIG. 1, wet-type developing device 4 includes a developer tank 13, a draw-up member 14, a supplying member 16, a developer carrier 9, a restriction blade 15, a toner charging device 17 serving as a charging unit, a charge neutralizing unit 19, a conductive roller 20, and a removing unit 18.

In developer tank 13, wet-type developer 12 described above is stored. Draw-up member 14 is provided to have a portion soaked in the wet-type developer inside developer tank 13. Moreover, draw-up member 14 is rotated in the direction of arrow D in the figure. As draw-up member 14, a rubber roller made of urethane or NBR or an anilox roller having a recess provided on its surface can be employed.

Supplying member 16 is disposed between draw-up member 14 and developer carrier 9 in abutment with both draw-up member 14 and developer carrier 9. Supplying member 16 is rotated in the direction of arrow E in the figure. A rubber roller made of urethane or NBR (nitrile butadiene rubber) can be employed as supplying member 16.

Developer carrier 9 is disposed between photoconductor drum 1 and supplying member 16 in abutment with both photoconductor drum 1 and supplying member 16. Developer carrier 9 is rotated in the direction of arrow F in the figure. Around developer carrier 9, supplying member 16, toner charging device 17, photoconductor drum 1, charge neutralizing unit 19, conductive roller 20, and removing unit 18 are disposed in this order in the rotation direction of developer carrier 9.

It should be noted that the relative rotation directions of draw-up member 14, supplying member 16, and developer carrier 9 may be different from the rotation directions described above. Further, supplying member 16 may be omitted and draw-up member 14 may also serve as supplying member 16 described below.

As toner charging device 17, a corotron, a scorotron, a discharging roller, or the like can be employed. As removing unit 18, a cleaning blade or the like can be employed.

As charge neutralizing unit 19, a DC corotron can be employed. The DC corotron is configured to have no grid electrode near the surface of wet-type developer 12, and is therefore less likely to be contaminated by the carrier liquid or the like. Accordingly, charges in wet-type developer 12 after the development can be neutralized stably.

At a nip portion between conductive roller 20 and developer carrier 9, conductive roller 20 is preferably rotated in the same direction as the movement direction of developer carrier 9. Moreover, the peripheral speed of conductive roller 20 is preferably the same as the peripheral speed of developer carrier 9.

As conductive roller 20, various types of known rollers used to form a bias electric field in an electrophotographic device can be used, such as: a metal roller composed of a material such as aluminum, iron, or stainless steel; a roller obtained by coating the outer circumferential surface of the base body of the metal roller with a conductive resin or elastic member; and a roller obtained by coating the surface of the roller, coated with the conductive resin or elastic member, with an insulating material thin enough to form an electric field.

For the development, draw-up member 14 is first rotated in the direction of arrow D shown in the figure, thereby drawing up wet-type developer 12 onto the surface of draw-up member 14. The wet-type developer drawn up onto the surface of draw-up member 14 is restricted to have a certain film thickness by restriction blade 15 provided in abutment with draw-up member 14.

After restricting wet-type developer 12, draw-up member 14, which is in abutment with supplying member 16, passes wet-type developer 12 to supplying member 16. Supplying member 16, which is rotated in a direction opposite to the rotation direction of developer carrier 9 at its portion (nip portion) in abutment with developer carrier 9, conveys the received wet-type developer 12 in that direction. Wet-type developer 12 is then passed onto developer carrier 9 at a portion at which supplying member 16 and developer carrier 9 face each other.

The toner particles in wet-type developer 12 having passed onto developer carrier 9 are charged by toner charging device 17 to a normal charge polarity. In accordance with an applied voltage, toner charging device 17 can change an amount of charges provided to the toner particles. It should be noted that the normal charge polarity is one of the negative polarity and the positive polarity.

With the rotation of developer carrier 9 in the direction of arrow F in the figure, wet-type developer 12 having the charged toner particles is moved to a development nip portion, at which photoconductor drum 1 and developer carrier 9 face each other. At the development nip portion, a part of the toner particles contained in the developer carried on developer carrier 9 are brought into abutment with photoconductor drum 1, thereby developing the electrostatic latent image on photoconductor drum 1.

The charges of toner particles contained in wet-type developer 12 not used for the development and remaining on developer carrier 9 are neutralized by charge neutralizing unit 19. The toner particles neutralized in charge pass through an AC electric field formed by applying an AC bias between conductive roller 20 and developer carrier 9, and are accordingly dispersed in the carrier liquid. Conductive roller 20 and developer carrier 9 serve as a dispersing unit for dispersing the toner particles in the carrier liquid.

Wet-type developer 12 having the toner particles dispersed therein is removed from developer carrier 9 by removing unit 18. A process of removing such a wet-type developer 12 will be described below in detail.

Wet-type developer 12 removed by removing unit 18 has a toner density different from that of wet-type developer 12 in developer tank 13, and is therefore recovered to a developer recovery tank (not shown) different from developer tank 13. Wet-type developer 12 thus recovered is adjusted in toner density and is then returned to developer tank 13 again.

(Process of Removing Wet-Type Developer)

Referring to FIG. 2 to FIG. 5, the following describes the process of removing wet-type developer 12 from developer carrier 9.

In the removing process, charge neutralizing unit 19 first neutralizes charges in a toner layer 123, which is formed when toner particles in wet-type developer 12 after the development are adsorbed onto surface 9*a* of developer carrier 9 in the form of a layer. Next, the toner particles contained in toner layer 123 neutralized in charge are dispersed by applying an AC bias between conductive roller 20 and developer carrier 9 serving as the dispersing unit. By performing the neutralization of charges and the dispersion in this order, the electrostatic binding force of developer carrier 9 on the toner particles is sufficiently canceled, whereby wet-type developer 12 on developer carrier 9 can be removed securely by removing unit 18. Hereinafter, a reason thereof will be described.

Figure 2:
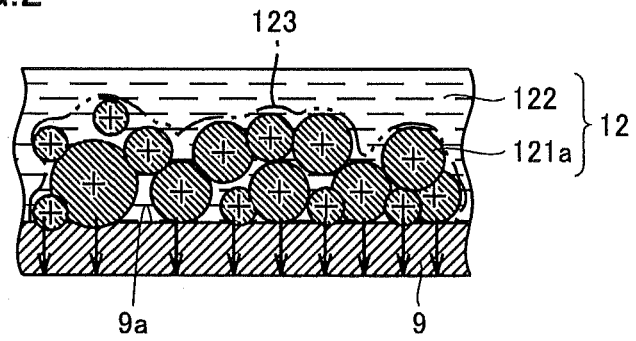
FIG. 2 is a schematic view showing a state of toner particles contained in a wet-type developer after development in the wet-type developing device shown in FIG. 1.

As shown in FIG. 2, toner particles 121*a* having passed through the development nip portion between photoconductor drum 1 and developer carrier 9 are charged to have the normal charge polarity (for example, the positive polarity). In addition to such a fact that charged toner particles are attracted to a conductive member by image force, in a region external to the region of the electrostatic latent image and not serving as the image, toner particles 121*a* are pushed to the developer carrier 9 side at the development nip portion due to the bias applied between photoconductor drum 1 and developer carrier 9, so that toner particles 121*a* after the development exist in the form of toner layer 123 on the surface of developer carrier 9. Furthermore, toner particles 121*a* are strongly bound to developer carrier 9 by electrostatic force as indicated by arrows in the figure.

Figure 3:
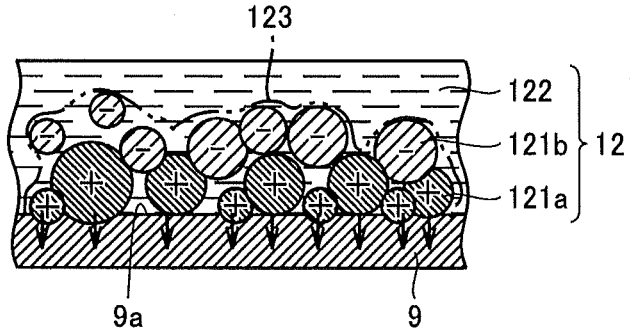
FIG. 3 is a schematic view showing a state of toner particles contained in a wet-type developer after neutralization of charges by a charge neutralizing unit in the wet-type developing device shown in FIG. 1.

As shown in FIG. 3, charge neutralizing unit 19 first neutralizes charges in toner layer 123 electrostatically adsorbed on surface 9*a* of developer carrier 9. Accordingly, the upper side of toner layer 123 is provided with charges (negative charges) opposite in polarity to the charges having the normal polarity for the toner, thereby canceling, on the average, the charges held by toner layer 123 (toner particles 121*a*) during the development. The amount of neutralized charges of the toner particles by charge neutralizing unit 19 will be described later in detail.

In toner layer 123 just after the neutralization of charges, toner particles 121*a* having been provided with charges (positive charges) having the normal polarity for the toner and therefore having been positively charged before the development exist locally at the surface 9*a* side of developer carrier 9, and toner particles 121*b* having been provided with charges (negative charges) having the polarity opposite to the normal polarity and therefore having been negatively charged exist locally at the front side of toner layer 123 opposite to the surface 9*a* side of developer carrier 9. Accordingly, as indicated by the arrows in the figure, the electrostatic binding force acting between toner particles 121*a* locally existing at the surface 9*a* side of developer carrier 9 and surface 9*a* of developer carrier 9 is not completely canceled, with the result that the electrostatic binding force remains to some extent. Thus, the state in which toner layer 123 locally exist in wet-type developer 12 at the surface 9*a* side of developer carrier 9 cannot be eliminated only by the neutralization of charges.

Next, an AC bias is applied between developer carrier 9 and conductive roller 20 that is in abutment with developer carrier 9 with wet-type developer 12 being interposed therebetween, thereby dispersing toner particles 121*a*, 121*b* included in toner layer 123 in the above state.

As the applied AC bias, an AC bias can be employed which has a waveform such as a square wave, a sign wave, a triangular wave, a saw-tooth wave, or a blank wave. The AC bias preferably has a frequency of not less than 1000 Hz and not more than 100000 Hz. When the frequency is less than 1000 Hz, the AC bias is applied unevenly depending on locations, which results in a region involving an insufficient dispersing effect. On the other hand, when the frequency is more than 100000 Hz, the toner particles cannot follow a change in the AC electric field, which may result in an insufficient dispersing effect.

Further, the amplitude of the AC voltage is preferably set up to about 1000 V so as to suppress occurrence of discharging. In the case where surface 9*a* of developer carrier 9 or the surface of conductive roller 20 is coated with an insulative member, a higher voltage can be applied. It should be noted that a DC bias may be superimposed on the AC bias.

By applying the AC bias, an AC electric field is formed between conductive roller 20 and developer carrier 9. Based on the AC electric field, toner particles 121*a* having the positive polarity and toner particles 121*b* having the negative polarity in toner layer 123 are separated from surface 9*a* of developer carrier 9 at the nip portion between developer carrier 9 and conductive roller 20 and each of them is moved in opposite directions. In order to more uniformly move the toner particles having the different polarities, the AC bias preferably has an average potential as large as the surface potential of developer carrier 9.

While the AC electric field becomes weaker gradually in the vicinity the outlet of the nip portion between developer carrier 9 and conductive roller 20, toner particles 121*a* having the positive polarity and toner particles 121*b* having the negative polarity flow in carrier liquid 122 and attract each other.

Figure 4:
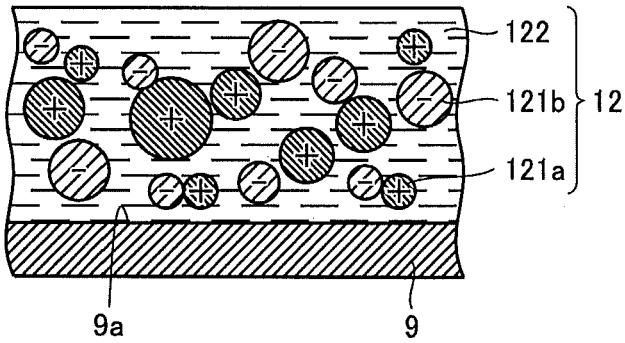
FIG. 4 is a schematic view showing a state of the toner particles contained in the wet-type developer after dispersion by a dispersing unit in the wet-type developing device shown in FIG. 1.

As a result, as shown in FIG. 4, pairs of toner particles 121*a* having the positive polarity and toner particles 121*b* having the negative polarity, both of which have existed locally in toner layer 123 such that the polarity differs between the upper side (front side) and the lower side (surface 9*a* side of developer carrier 9) after the neutralization of charges, flow in carrier liquid 122.

The pairs of toner particles 121*a*, 121*b* having the positive and negative polarities are not substantially adsorbed to developer carrier 9 based on electrostatic force and are therefore released from the electrostatic binding force provided by the developer carrier. Accordingly, the plurality of pairs of toner particles 121*a*, 121*b* having the positive and negative polarities are dispersed in carrier liquid 122.

Toner particles 121*a* locally existing at the surface 9*a* side of developer carrier 9 are dispersed in carrier liquid 122, thereby preventing separation into a high toner density portion and a low toner density portion in wet-type developer 12. Accordingly, the viscosity of wet-type developer 12 also becomes substantially uniform, thereby preventing the viscosity from being high at the surface 9*a* side of developer carrier 9.

Figure 5:
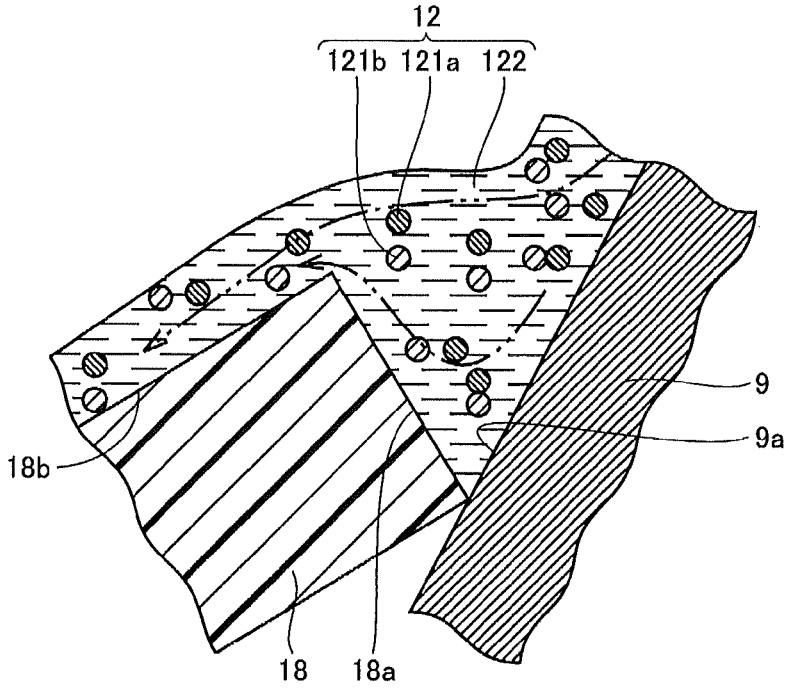
FIG. 5 is a schematic view showing that the wet-type developer after the dispersion is removed by the removing unit in the wet-type developing device shown in FIG. 1.

Next, wet-type developer 12 having toner particles 121*a*, 121*b* dispersed therein are recovered from developer carrier 9 by removing unit 18. On this occasion, toner particles 121*a*, 121*b* are dispersed almost uniformly in carrier liquid 122. Hence, as shown in FIG. 5, toner particles 121*a*, 121*b* are not accumulated between end surface 18*a* of removing unit 18 and surface 9*a* of developer carrier 9, and are recovered to the developer recovery tank (not shown) together with carrier liquid 122 via upper surface 18*b* of removing unit 18 as shown in the chain double-dashed lines in the figure.

(As to Amount of Charges Neutralized by Charge Neutralizing Unit)

Figure 6:
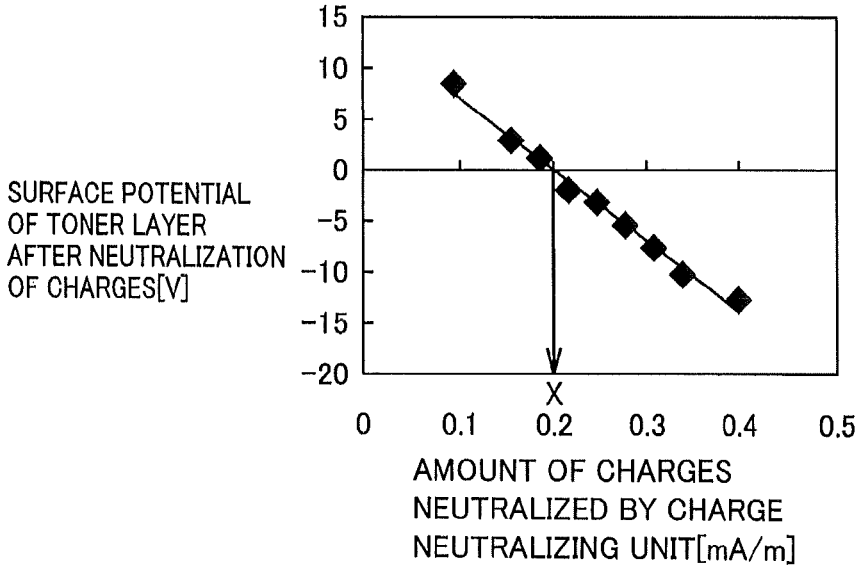
FIG. 6 shows a relation between an amount of neutralized charges of the toner particles by the charge neutralizing unit shown in FIG. 1 and the surface potential of the toner layer after the neutralization of charges.
Figure 7:
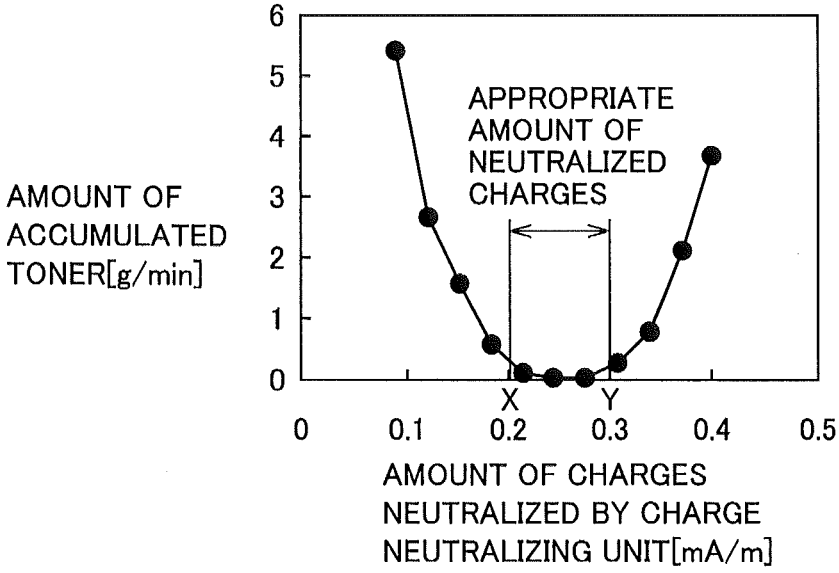
FIG. 7 shows a relation between the amount of neutralized charges of the toner particles by the charge neutralizing unit shown in FIG. 1 and the amount of the toner particles accumulated on the removing unit.

The state of toner particles 121*a*, 121*b* after the dispersion provided by conductive roller 20 becomes better as the amount of neutralized charges of the toner particles by charge neutralizing unit 19 is more appropriate. Referring to FIG. 6 and FIG. 7, the following describes the amount of charges neutralized by the charge neutralizing unit.

As shown in FIG. 6, as the amount of neutralized charges of the toner particles by charge neutralizing unit 19 is increased, the surface potential of toner layer 123 is shifted from the positive potential to the negative potential. The surface potential of toner layer 123 becomes zero when the amount of charges neutralized by the charge neutralizing unit is at an X point shown in the figure. That is, when the amount of neutralized charges is 0.2 [mA/m], the surface potential of toner layer 123 becomes zero.

Here, the amount of neutralized charges of the toner particles by charge neutralizing unit 19 is in proportion to an amount of current I supplied to toner layer 123 from the corotron used as charge neutralizing unit 19 (an amount of current flowing from the charge neutralizing device to the developer carrier per unit length in the longitudinal direction). The amount of current I can be calculated by subtracting the amount of current having flown in the casing of the corotron from the amount of current having flown in the wire of the corotron.

The amount of accumulation of the toner particles as shown in FIG. 7 is measured in the following manner: wet-type developing device 4 is driven for one minute; wet-type developer 12 located near the abutment portion between removing unit 18 and developer carrier 9 is then scooped and recovered by 10 cm in width in the longitudinal direction (the extending direction of the developer carrier); and the weight of the toner particles obtained by drying carrier liquid 122 is measured.

As shown in FIG. 7, the amount of accumulation of the toner particles becomes substantially zero when the amount of neutralized charges of the toner particles by charge neutralizing unit 19 falls within a range from the X point to a Y point shown in the figure. In other words, the amount of accumulation of the toner particles becomes substantially zero when the amount of neutralized charges is not less than 0.2 [mA/m] and not more than 0.3 [mA/m]. Here, the Y point represents such a point that the amount of neutralized charges of the toner particles by charge neutralizing unit 19 is equal to the amount of charges provided to the toner particles by toner charging device 17 before the development.

Moreover, as the amount of neutralized charges becomes further away from the range from the X point to the Y point, the amount of accumulation of the toner particles is increased. The range in which substantially no accumulation of toner particles takes place is not centered on the X point at which the surface potential of toner layer 123 becomes zero by the neutralization of charges, and exists to be shifted from the X point to the side of polarity (negative polarity) of the charges provided by the neutralization of charges.

An ideal charge neutralization state to cancel the electrostatic binding force of developer carrier 9 to the toner particles is such that the amount of charges of toner particles 121*a* contained in wet-type developer 12 remaining on developer carrier 9 immediately after the development and the amount of neutralized charges of the toner particles by charge neutralizing unit 19 are substantially equal to each other in amount and are balanced with each other.

In such a charge neutralization state, as shown in FIG. 3, the charges of the negative polarity provided by the neutralization of charges locally exist in toner layer 123 at the front side opposite to surface 9*a* of developer carrier 9. Accordingly, the surface potential of toner layer 123 in the ideal charge neutralization state is not zero, and is shifted to the negative polarity side.

When the surface potential of toner layer 123 after the neutralization of charges has the positive polarity, the amount of neutralized charges is insufficient, so that toner layer 123 is bound to surface 9*a* of developer carrier 9 by electrostatic force. As a result, the viscosity of the wet-type developer becomes high at the surface 9*a* side of developer carrier 9, with the result that the toner particles are accumulated on removing unit 18 during the removal.

In order to prevent such insufficient neutralization of charges and suppress the accumulation of toner particles, the amount of neutralized charges of the toner particles by charge neutralizing unit 19 is preferably set at the X point or more such that the surface potential of toner layer 123 after the neutralization of charges is zero or a value slightly shifted from zero to the side of polarity of the charges provided by the neutralization of charges.

On the other hand, also when an excessive amount of charges is neutralized and the amount of neutralized charges is much larger than the amount of charges of toner layer 123, toner layer 123 is bound by electrostatic force onto surface 9*a* of developer carrier 9. As a result, the viscosity of the wet-type developer becomes high at the surface 9*a* side of developer carrier 9, with the result that the toner particles are accumulated on removing unit 18 during the removal.

Here, the case where the excessive amount of charges is neutralized refers to a case where the amount of neutralized charges becomes larger than the amount of charges held by the toner particles immediately after being charged by toner charging device 17. The amount of charges of the toner particles may be reduced little by little with passage of time, so that the amount of charges held by the toner particles immediately after being charged by toner charging device 17 is not necessarily maintained without change until the neutralization of charges. However, the amount of charges of toner layer 123 immediately after the development does not exceed the amount of charges of the toner particles immediately after being charged by toner charging device 17. Hence, it can be said that the excessive amount of charges is neutralized when the Y point is exceeded at which the amount of neutralized charges of the toner particles by charge neutralizing unit 19 becomes equal to the amount of charges held by the toner particles immediately after being charged by toner charging device 17.

In order to prevent the excessive neutralization of charges and suppress the accumulation of toner particles, the amount of neutralized charges of the toner particles by charge neutralizing unit 19 is preferably set to be equal to or less than the Y point.

When setting the amount of neutralized charges to be equal to or less than the Y point, reference can be made to: an amount of neutralized charges per effective unit area of developer carrier 9 when neutralizing the charges of the toner particles by charge neutralizing unit 19; and an amount of charges provided to the toner particles by toner charging device 17 per effective unit area of developer carrier 9.

The amount of neutralized charges of the toner particles by charge neutralizing unit 19 is in proportion to the amount of current I supplied to toner layer 123 from the corotron used as charge neutralizing unit 19, so that the amount of neutralized charges of the toner particles by charge neutralizing unit 19 per second is also in proportion to the amount of current I. The amount of neutralized charges of the toner particles by charge neutralizing unit 19 per second can be expressed as current amount n×I using constant n.

The amount of charges neutralized per second is given substantially uniformly with respect to effective surface area S of developer carrier 9 passing by charge neutralizing unit 19 per second.

Here, assuming that W [m] represents a width, by which charge neutralizing unit 19 can neutralize charges, in the longitudinal direction and that v [m/s] represents the peripheral speed of surface 9*a* of developer carrier 9, effective surface area S of developer carrier 9 passing below charge neutralizing unit 19 per second can be found by the following formula (1):

$$S=W\times v \qquad \text{Formula (1)}$$

As described above, the amount of charges ρ neutralized by charge neutralizing unit 19 per unit area of developer carrier 9 can be found by the following formula (2):

$$\rho=n\times I/(W\times v) \qquad \text{Formula (2)}$$

Based on the same idea as the one described above, when the corotron is used as toner charging device 17, the amount of charges provided to the toner particles by toner charging device 17 per unit area of developer carrier 9 can be found.

When the amount of charges neutralized by charge neutralizing unit 19 per unit area of developer carrier 9 is made equal to or less than the amount of charges provided by toner charging device 17 per unit area of developer carrier 9, the amount of neutralized charges of the toner particles by charge neutralizing unit 19 can be set to be equal to or less than the Y point.

When the amount of neutralized charges of the toner particles by charge neutralizing unit 19 is set to fall within the appropriate range as described above, the accumulation of toner can be further suppressed.

When each of wet-type developing device 4 and wet-type image forming apparatus 100 including wet-type developing device 4 in the present embodiment is configured as described above, the toner particles are dispersed in the carrier liquid with the charges of the toner particles after the development being canceled by the charge neutralizing unit, whereby the toner particles can be prevented from being adhered to developer carrier 9 again before removing them by the removing unit. Accordingly, the toner particles contained in wet-type developer 12 remaining on developer carrier 9 after the development can be suppressed from being accumulated on removing unit 18.

Moreover, since the toner particles are not accumulated on removing unit 18, the toner particles can be repeatedly used by adjusting, in the toner density, the wet-type developer removed and recovered to the developer recovery tank, and then conveying it to the developer tank. Accordingly, the toner particles can be efficiently reused.

Furthermore, since the toner particles are not accumulated on removing unit 18, the surroundings of removing unit 18 can be prevented from being contaminated, thereby improving maintainability. In addition, image noise can be suppressed from being generated.

(Modification 1)

Figure 8:
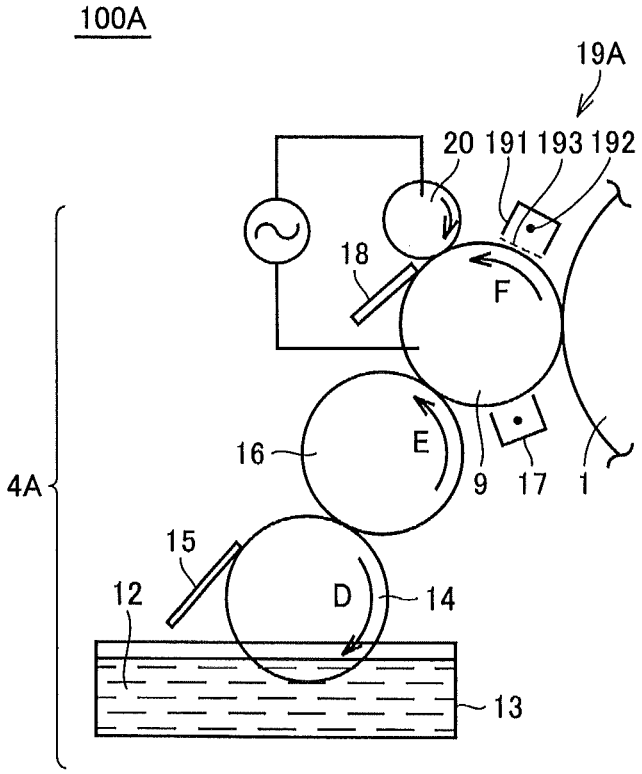
FIG. 8 is a schematic view showing a configuration of a wet-type developing device provided in a wet-type image forming apparatus according to a modification 1.

Referring to FIG. 8, a wet-type image forming apparatus 100A according to the present modification will be described.

As shown in FIG. 8, wet-type image forming apparatus 100A according to the present modification is different from wet-type image forming apparatus 100 according to the first embodiment in terms of the configuration of a wet-type developing device 4A and is substantially the same as wet-type image forming apparatus 100 according to the first embodiment in terms of the other configurations.

Wet-type developing device 4A is different from wet-type developing device 4 in that a DC scorotron or an AC scorotron is used as charge neutralizing unit 19A instead of the DC corotron.

Charge neutralizing unit 19A includes a shielding case 191, a discharging wire 192 serving as a discharging electrode, a grid electrode 193, and a power source (not shown) for applying voltage to the discharging wire.

The voltage applied to the discharging wire is a voltage to neutralize charges in the toner. The potential of grid electrode 193 is preferably determined in accordance with the surface potential of toner layer 123 after the neutralization of charges. The surface potential of toner layer 123 after the neutralization of charges is a potential with the same polarity as that of the charges provided by the neutralization of charges, so that the potential of grid electrode 193 is correspondingly preferably of the polarity opposite to the normal charge polarity for the toner.

When the DC scorotron is used as charge neutralizing unit 19A, the wire voltage is preferably about 3 kV to 10 kV, a case voltage applied to shielding case 191 is preferably 0V, and the potential of grid electrode 193 is preferably about 0 V to −10 V.

When the AC scorotron is used as charge neutralizing unit 19A, an AC voltage Vpp of about 6 kV to 20 kV is preferably applied to discharging wire 192 as a wire voltage and no DC voltage is preferably superimposed thereon with a DC voltage Vdc being 0 V. The case voltage applied to shielding case 191 is preferably 0V, and the potential of grid electrode 193 is preferably about 0 V to −10 V.

When the scorotron is used as charge neutralizing unit 19A, the surface potential of the toner layer after the neutralization of charges can be made constant more securely even when the amount of the toner layer of the wet-type developer and the amount of charges after the development are varied in accordance with a development pattern depending on a location on developer carrier 9.

Also with such a configuration, the toner particles are dispersed in the carrier liquid with the charges of the toner particles in wet-type developer 12 after the development being canceled by charge neutralizing unit 19A, whereby the toner particles can be prevented from being adhered to developer carrier 9 again before removing them by the removing unit.

Hence, each of wet-type developing device 4A and wet-type image forming apparatus 100A including wet-type developing device 4A in the present modification also attains substantially the same effect as that of wet-type developing device 4 and wet-type image forming apparatus 100 including wet-type developing device 4 in the first embodiment.

(Modification 2)

Figure 9:
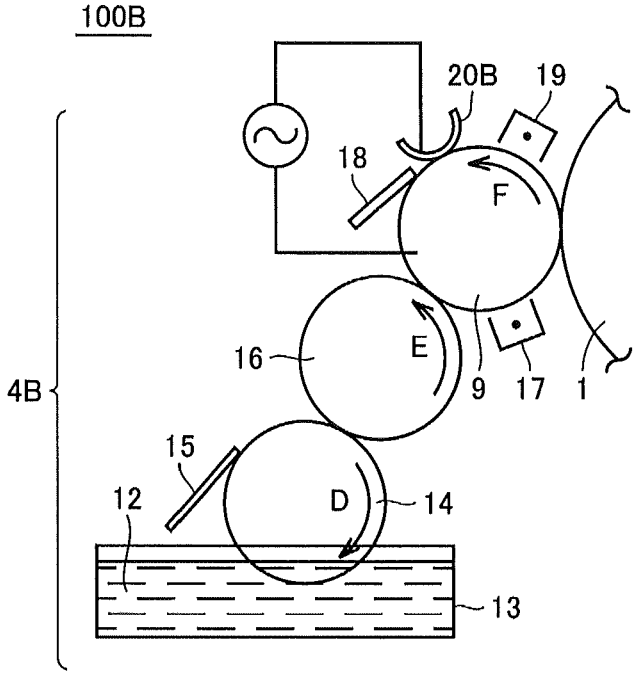
FIG. 9 is a schematic view showing a configuration of a wet-type developing device provided in a wet-type image forming apparatus according to a modification 2.

Referring to FIG. 9, a wet-type image forming apparatus 100B according to the present modification will be described.

As shown in FIG. 9, wet-type image forming apparatus 100B according to the present modification is different from wet-type image forming apparatus 100 according to the first embodiment in terms of the configuration of a wet-type developing device 4B and is substantially the same as wet-type image forming apparatus 100 according to the first embodiment in terms of the other configurations.

Wet-type developing device 4B is different from wet-type developing device 4 in that the dispersing unit is not the conductive roller but a conductive stationary member 20B.

Conductive stationary member 20B is disposed in contact with wet-type developer 12 on developer carrier 9. Stationary member 20B can have an appropriately selected shape, such as: a cylindrical shape; a plate-like shape; or a shape curved in the form of an arc when viewed in cross section such that its circumferential surface is in abutment with developer carrier 9 with wet-type developer 12 being interposed therebetween. Moreover, as the material of stationary member 20B, a material such as aluminum, iron, or stainless steel can be employed.

Also in such a configuration, an AC electric field can be formed by applying an AC bias between stationary member 20B and developer carrier 9. Accordingly, each of the toner particles having the different polarities can be moved in opposite directions, whereby the toner particles neutralized in charge after the development can be dispersed in the carrier liquid. As a result, the toner particles contained in wet-type developer 12 remaining on developer carrier 9 after the development can be suppressed from being accumulated on removing unit 18.

Hence, each of wet-type developing device 4B and wet-type image forming apparatus 100B including wet-type developing device 4B in the present modification also attains substantially the same effect as that of wet-type developing device 4 and wet-type image forming apparatus 100 including wet-type developing device 4 in the first embodiment.

(Modification 3)

Figure 10:
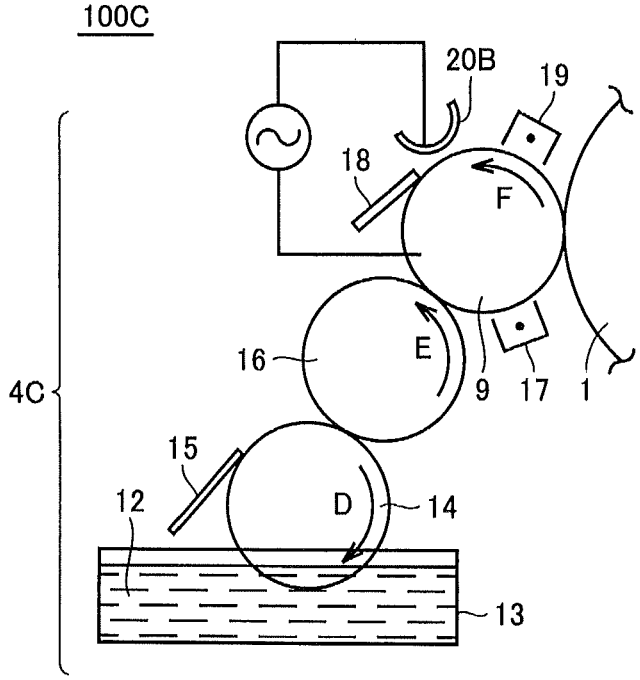
FIG. 10 is a schematic view showing a configuration of a wet-type developing device provided in a wet-type image forming apparatus according to a modification 3.

Referring to FIG. 10, a wet-type image forming apparatus 100C according to the present modification will be described.

As shown in FIG. 10, wet-type image forming apparatus 100C according to the present modification is different from wet-type image forming apparatus 100B according to modification 2 in that a conductive stationary member 20B serving as the dispersing unit in a wet-type developing device 4C is disposed to be spaced away from the wet-type developer so as not to make contact with wet-type developer 12 on developer carrier 9.

In the present modification, the average potential of the AC bias applied between stationary member 20B and developer carrier 9 is preferably a potential that attracts the toner particles from developer carrier 9 to the stationary member 20B side. Accordingly, even when stationary member 20B is not in contact with wet-type developer 12, an AC electric field for moving each of the toner particles having different polarities in the opposite directions can be formed more securely.

Also in such a configuration, the toner particles neutralized in charge after the development can be dispersed in the carrier liquid as long as an AC bias can be applied between stationary member 20B and developer carrier 9. As a result, the toner particles contained in wet-type developer 12 remaining on developer carrier 9 after the development can be suppressed from being accumulated on removing unit 18.

Each of wet-type developing device 4C and wet-type image forming apparatus 100C including wet-type developing device 4C in the present modification also attains substantially the same effect as that of wet-type developing device 4B and wet-type image forming apparatus 100B including wet-type developing device 4 in modification 2.

(Second Embodiment)

Figure 11:
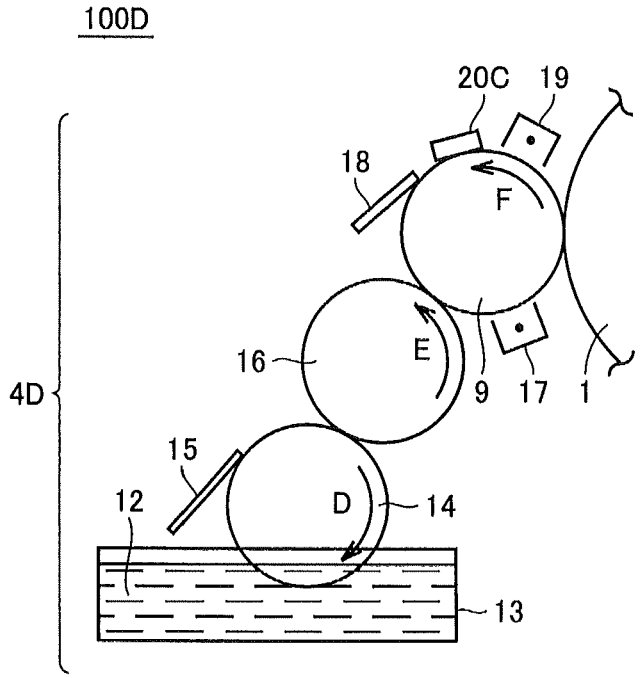
FIG. 11 shows a configuration of a wet-type developing device provided in a wet-type image forming apparatus according to a second embodiment of the present invention.

Referring to FIG. 11, a wet-type image forming apparatus 100D according to the present embodiment will be described.

As shown in FIG. 11, wet-type image forming apparatus 100D according to the present embodiment is different from wet-type image forming apparatus 100 according to the first embodiment in terms of the configuration of a wet-type developing device 4D and is substantially the same as wet-type image forming apparatus 100 according to the first embodiment in terms of the other configurations.

Wet-type developing device 4D is different from wet-type developing device 4 according to the first embodiment in that the dispersing unit is not conductive roller 20 and is a vibration providing member 20C for providing mechanical vibration, such as supersonic vibration, to toner layer 123 via wet-type developer 12.

Vibration providing member 20C is in abutment with developer carrier 9 with wet-type developer 12 on developer carrier 9 being interposed therebetween. Vibration providing member 20C is constructed of an ultrasonic vibrator, for example. When the ultrasonic vibrator vibrates during image formation, the supersonic vibration is transmitted to wet-type developer 12 and toner layer 123. Accordingly, in wet-type developer 12, toner layer 123 is raised from surface 9*a* of developer carrier 9 and the toner particles contained in toner layer 123 thus raised are diffused.

As a result, as with the first embodiment, pairs of toner particles 121*a* having the positive polarity and toner particles 121*b* having the negative polarity, both of which have existed locally in toner layer 123 such that the polarity differs between the upper side (front side) and the lower side (surface 9*a* side of developer carrier 9) after the neutralization of charges, flow in carrier liquid 122. The plurality of pairs of the toner particles, which are not bound to the developer carrier by electrostatic force, are dispersed in carrier liquid 122.

With such a configuration, also in the present embodiment, the toner particles are dispersed in the carrier liquid with the charges of the toner particles after the development being canceled by charge neutralizing unit 19A, whereby the toner particles can be prevented from being adhered to developer carrier 9 again before removing them by the removing unit. Accordingly, the toner particles contained in wet-type developer 12 remaining on developer carrier 9 after the development can be suppressed from being accumulated on removing unit 18.

Each of wet-type developing device 4D and wet-type image forming apparatus 100D including wet-type developing device 4D in the present modification also attains substantially the same effect as that of wet-type developing device 4 and wet-type image forming apparatus 100 including wet-type developing device 4 in the first embodiment.

(Third Embodiment)

Figure 12:
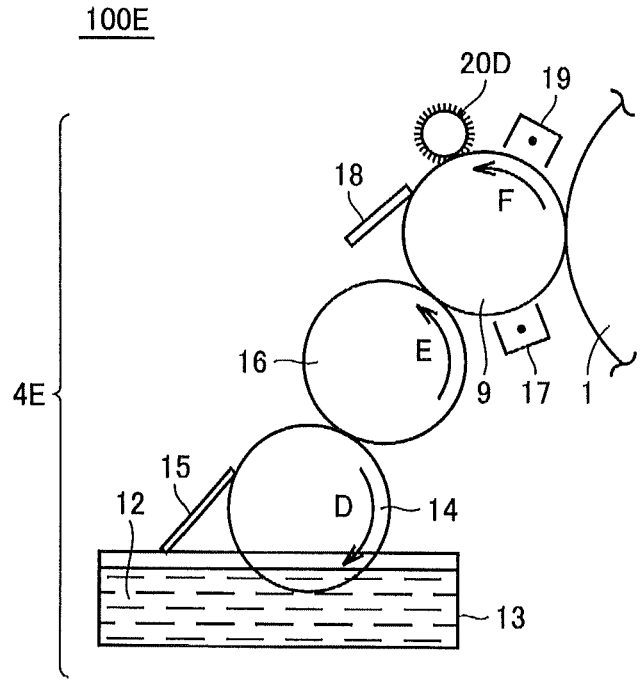
FIG. 12 shows a configuration of a wet-type developing device provided in a wet-type image forming apparatus according to a third embodiment of the present invention.

Referring to FIG. 12, a wet-type image forming apparatus 100E according to the present embodiment will be described.

As shown in FIG. 12, wet-type image forming apparatus 100E according to the present modification is different from wet-type image forming apparatus 100 according to the first embodiment in terms of the configuration of wet-type developing device 4E and is substantially the same as wet-type image forming apparatus 100 according to the first embodiment in terms of the other configurations.

Wet-type developing device 4E is different from wet-type developing device 4 according to the first embodiment in that the dispersing unit is not conductive roller 20 and is a brush member 20D for slidably making contact with developer carrier 9 so as to diffuse the toner particles contained in wet-type developer 12.

Brush member 20D is made of a material by which the contact with the toner can be made at a high rate, and a brush roller for directly diffusing the toner can be employed. As the material by which the contact with the toner can be made at a high rate, a metal fiber, an acrylic fiber, a nylon fiber, or the like can be employed. It should be noted that instead of the brush roller, there may be used a sponge roller made of a material having flexibility provided by foaming the surface thereof.

As compared with a metal roller or rubber roller having a surface with a curved shape, brush member 20D thus configured can partially make contact with the toner particles aggregated in the form of a layer. Accordingly, frictional force can be provided to the toner layer to separate the aggregated toner particles from each other, thereby exhibiting the dispersing effect securely.

Moreover, the rotation direction of the brush member and the speed thereof can be selected appropriately. For example, the brush member may be rotated at the nip portion between the brush member and developer carrier 9 in a direction opposite to the movement direction of developer carrier 9 or in the same direction as the movement direction of developer carrier 9. On this occasion, the rotation speed of the brush member may be set to be the same as the rotation speed of developer carrier 9, or may be set to be different from the rotation speed of developer carrier 9.

In the case where the rotation direction of the brush member is set to be the same as the movement direction of developer carrier 9 at the nip portion between the brush member and developer carrier 9, it is preferable to provide a speed range so as not to cause a side effect such as generation of heat or scattering of the developer. In this way, the effect of dispersing the toner particles in the carrier liquid is assisted.

Brush member 20D is in abutment with developer carrier 9 with wet-type developer 12 on developer carrier 9 being interposed therebetween. When the brush roller is rotated slidably in contact therewith during the image formation, the brush in contact with toner layer 123 provides frictional force to toner layer 123 mechanically. Accordingly, in wet-type developer 12, toner layer 123 is raised from surface 9*a* of developer carrier 9 and the toner particles contained in toner layer 123 thus raised are diffused.

As a result, as with the first embodiment, pairs of toner particles 121*a* having the positive polarity and toner particles 121*b* having the negative polarity, both of which have existed locally in toner layer 123 such that the polarity differs between the upper side (front side) and the lower side (surface 9*a* side of developer carrier 9) after the neutralization of charges, flow in carrier liquid 122. The plurality of pairs of the toner particles, which are not bound to the developer carrier by electrostatic force, are dispersed in carrier liquid 122.

Also in the present embodiment, with such a configuration, the toner particles are dispersed in the carrier liquid with the charges of the toner particles after the development being canceled by the charge neutralizing unit, whereby the toner particles can be prevented from being adhered to developer carrier 9 again before removing them by the removing unit. Accordingly, the toner particles contained in wet-type developer 12 remaining on developer carrier 9 after the development can be suppressed from being accumulated on removing unit 18.

Each of wet-type developing device 4E and wet-type image forming apparatus 100E including wet-type developing device 4E in the present modification also attains substantially the same effect as that of wet-type developing device 4 and wet-type image forming apparatus 100 including wet-type developing device 4 in the first embodiment.

(Fourth Embodiment: Setting Optimal Amount of Neutralized Charges Through Surface Potential Measurement)

Figure 13:
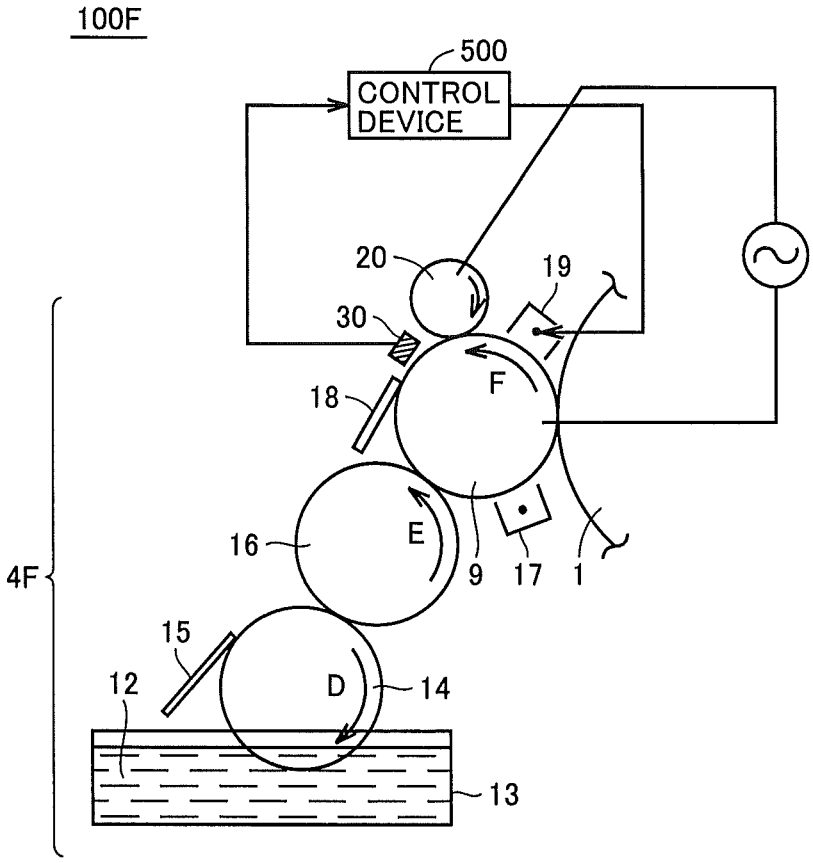
FIG. 13 shows a configuration of a wet-type developing device provided in a wet-type image forming apparatus according to a fourth embodiment of the present invention.

Referring to FIG. 13, a wet-type image forming apparatus 100F according to the present embodiment will be described.

As shown in FIG. 13, wet-type image forming apparatus 100F according to the present embodiment is different from wet-type image forming apparatus 100 according to the first embodiment in terms of the configuration of a wet-type developing device 4F and is substantially the same as wet-type image forming apparatus 100 according to the first embodiment in terms of the other configurations.

The following describes a case where wet-type developing device 4F is provided with a mechanism to further improve precision in the setting of the amount of neutralized charges in the first embodiment. It has been illustrated in the first embodiment that the ideal charge neutralization state is such that the initial amount of charges (positive polarity in the present embodiment) of the toner remaining on wet-type developer 12 after the development is substantially equal to and balanced with the amount of neutralized charges (negative polarity) provided by charge neutralizing unit 19.

Further, it has been also illustrated that in wet-type developer 12 having passed by charge neutralizing unit 19, the charges having the polarity as provided by the neutralization of charges are away from developer carrier 9 (see FIG. 3), so that when an optimal charge neutralization output is set, the surface potential is not zero but is shifted to the side (negative side) of polarity of the neutralized charges. The setting range for the charge neutralization output has been illustrated.

Here, as described in the first embodiment, based on the surface potential of developer carrier 9 after passing by charge neutralizing unit 19, the value range therefor can be estimated, but the optimal amount of neutralized charges is not determined uniquely. The range for the optimal amount of neutralized charges is changed also depending on the state of wet-type developer 12 after the development and the environment around the wet-type developing device, so that it is desirable to always control to attain the optimal amount of neutralized charges with good precision.

Therefore, as shown in FIG. 13, in the present embodiment, surface potential measuring unit 30 for measuring the surface potential on developer carrier 9 is provided on developer carrier 9 at a downstream side relative to conductive roller 20 serving as the dispersing unit and at an upstream side relative to removing unit 18 in the rotation direction of developer carrier 9. Based on the surface potential obtained by surface potential measuring unit 30, a control device 500 controls the amount of charges neutralized by charge neutralizing unit 19. In this case, the optimal amount of neutralized charges is such an amount that the surface potential of wet-type developer 12 becomes 0 (the value of the bias when the bias is applied to developer carrier 9). A reason of this will be described below. It should be noted that control device 500 may be a dedicated control device or may be added in a control device of the wet-type image forming apparatus.

As described in the first embodiment, in toner layer 123 having passed by charge neutralizing unit 19 after the development, positive charges and negative charges locally exist in the vicinity of developer carrier 9 and in the side opposite thereto (see FIG. 3). Here, toner layer 123 including the locally existing charges of both the polarities passes by conductive roller 20, whereby toner layer 123 flows to form pairs of positive and negative charges. In this state, the locally existing charges before passing by conductive roller 20 are canceled (see FIG. 4).

Therefore, in the ideal charge neutralization state, i.e., in the state in which substantially the same amount of charges as the amount of charges of the normal polarity are provided, the surface potential becomes 0 (the value of the developing bias when the developing bias is applied).

Figure 14:
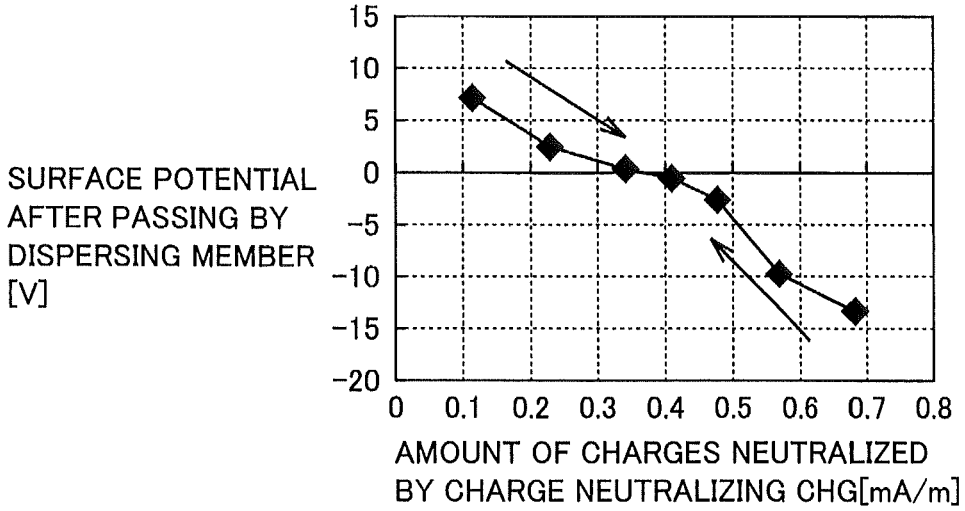
FIG. 14 shows a relation between the amount of neutralized charges of the toner particles by the charge neutralizing unit shown in FIG. 13 and the surface potential of the toner layer after the neutralization of charges.
Figure 15:
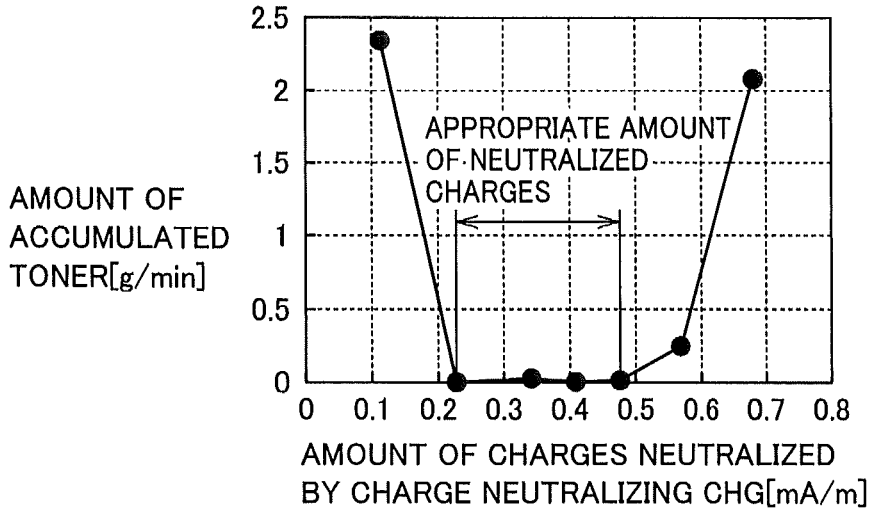
FIG. 15 shows a relation between the amount of neutralized charges of the toner particles by the charge neutralizing unit shown in FIG. 13 and the amount of toner particles accumulated on the removing unit.

Actually, each of FIG. 14 and FIG. 15 shows one example representing a relation between the surface potential on developer carrier 9 after passing by conductive roller 20 and the accumulated toner amount. In comparison with FIG. 6 and FIG. 7, it is understood that the surface potential range for the appropriate amount of neutralized charges is shifted to a vicinity of 0 with 0 being as its center. From the description above, the surface potential on developer carrier 9 after passing by conductive roller 20 is measured, and the amount of neutralized charges is controlled (controlled as indicated by arrows in FIG. 14) to be 0 (the value of the developing bias when the developing bias is applied). In other words, by controlling to attain the ideal state in which the pairs of positive and negative charges are dispersed, the accumulation of toner can be suppressed with good precision.

Moreover, since the measurement position is positioned just before removing unit 18, the optimal amount of neutralized charges for suppressing the accumulation of toner can be set more precisely without being affected by, for example, the change in the amount of charges in the toner caused by passing by conductive roller 20 as well as the reduction in the amount of charges during a period of time from the provision of charges to the neutralization of charges.

Furthermore, in the configuration of the present embodiment, irrespective of the environment and the state of wet-type developer 12 after the development, the optimal amount of neutralized charges can be found uniquely. Hence, the surface potential of developer carrier 9 can be controlled precisely based on the result of measurement by surface potential measuring unit 30 even during image formation on photoconductor drum 1.

Figure 16:
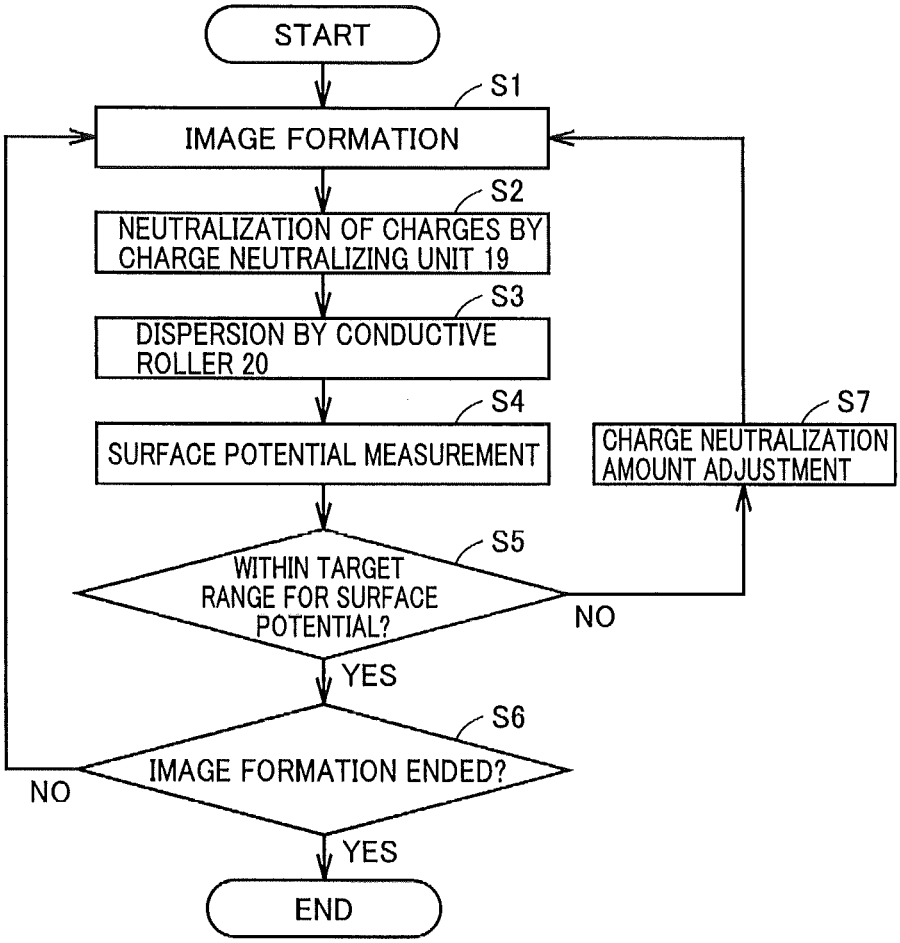
FIG. 16 shows a flow of image formation in the wet-type image forming apparatus according to the fourth embodiment of the present invention.

Specifically, the following illustrates an exemplary sequence shown in FIG. 16 during the image formation. A toner image is formed on photoconductor drum 1 (S1), then charges of wet-type developer 12, corresponding to the toner image formed on photoconductor drum 1, after the development are neutralized by means of a charge neutralization output set in advance (S2), then wet-type developer 12 after the development passes by conductive roller 20 (S3), and then the surface potential is measured (S4). The amount of neutralized charges is controlled sequentially such that the surface potential comes close to a target range around 0 (the value of the developing bias when the developing bias is applied) (S5, S6, S7). These operations are sequentially performed until completion of the image formation on photoconductor drum 1 (S6). With this, the accumulation of toner can be suppressed with good precision.

Regarding the range for the amount of neutralized charges, the following formula (3) may be satisfied, assuming that Vts represents the surface potential after passing by conductive roller 20 and Vrs represents the surface potential of developer carrier 9 when there is no toner on the surface:

$$|5| \geq Vts - Vrs(V) \qquad \text{Formula (3)}$$

Further, when the developing bias is applied, Vrs represents the value of the developing bias.

As a result of conducting experiments on various types of wet-type developers 12, the accumulation of toner can be suppressed with good precision by empirically controlling the amount of neutralized charges to fall within this range.

(Fifth Embodiment)

The fourth embodiment described above has illustrated the method of optimally setting the amount of neutralized charges with good precision by controlling charge neutralizing unit 19 based on the surface potential after wet-type developer 12 after the development passes by conductive roller 20. Also illustrated is the method of dealing with the change in environment and wet-type developer 12 by performing control during the image formation on photoconductor drum 1.

In the present embodiment, the following describes a method of controlling the amount of neutralized charges using a patch image in a region other than the image formation region on photoconductor drum 1. In the fourth embodiment, a toner image coming to removing unit 18 via charge neutralizing unit 19 is changed according to an output image to photoconductor drum 1. As described below, since the optimal amount of neutralized charges may be also changed depending on an image, the charge neutralizing current is controlled in accordance with a change of image whenever the image is changed. In the present embodiment, by controlling the amount of neutralized charges in accordance with wet-type developer 12 after development of a patch image of a predetermined image, the control for the amount of neutralized charges is performed less frequently, whereby the neutralization of charges can be performed more stably.

Figure 17:
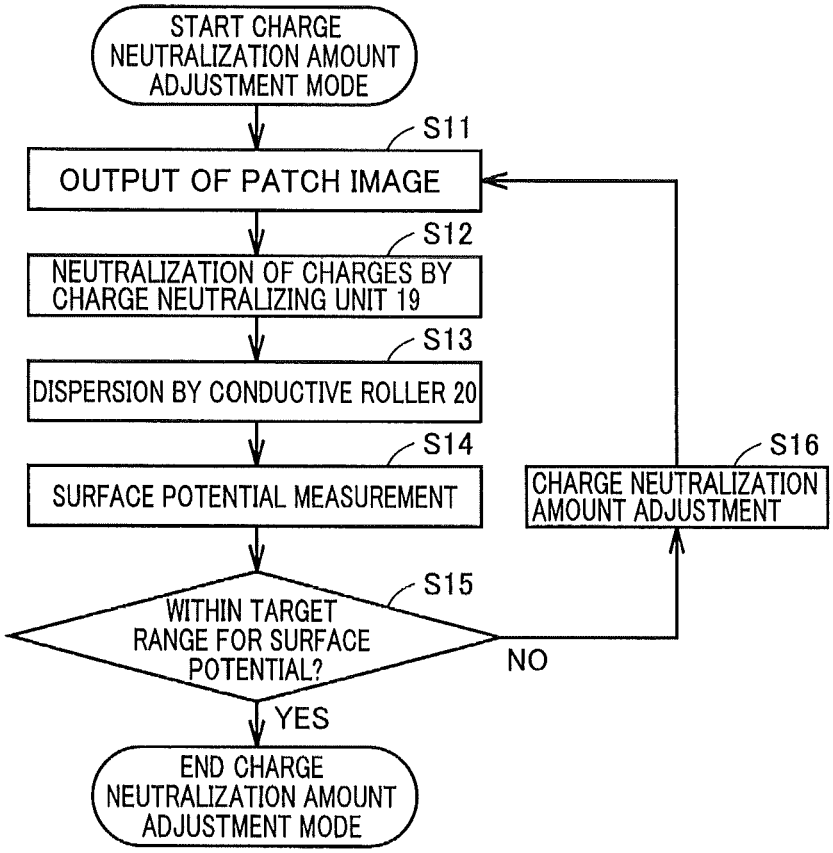
FIG. 17 shows a flow of image formation in a wet-type image forming apparatus according to a fifth embodiment of the present invention.

Specifically, the amount of neutralized charges is controlled based on the surface potential of developer carrier 9 after development of a patch image, which is formed in any region during a start sequence in which the image forming apparatus starts to operate or is formed in a region between toner images or a region out of a range of a toner image during image formation after the start of operation. With this, the optimal amount of neutralized charges can be attained stably. FIG. 17 shows a flowchart of an exemplary control sequence in the present embodiment.

First, a charge neutralization amount adjustment sequence is started. As image formation conditions (the amount of charges, the developing bias, the amount of exposure, and the like), conditions determined in advance and corresponding to a type of sheet or a type of color are employed. When the adjustment sequence is started, first, a patch image for use in the adjustment of the amount of neutralized charges is output and is developed on photoconductor drum 1 (S11). After the patch image is developed on photoconductor drum 1, charges of wet-type developer 12 after the development are neutralized by the preset amount of neutralized charges (S12).

Next, wet-type developer 12 after the development is subjected to the dispersion by conductive roller 20 (S13), and the surface potential of wet-type developer 12 after the development is measured (S14). On this occasion, when the surface potential of wet-type developer 12 after the development falls within the target range around the developing bias (S15), the adjustment mode is ended. On the other hand, when the surface potential of wet-type developer 12 after the development does not fall within the target range, the amount of neutralized charges is adjusted (S16) and an adjustment patch is output again.

(Modification of Fifth Embodiment)

While it has been described that the amount of neutralized charges is set in advance, it is also considered that precision in setting the amount of neutralized charges to suppress the accumulation of toner might be bad, for example, upon starting the wet-type image forming apparatus, upon changing types of sheets, or the like. In such a case, the amount of charges neutralized in wet-type developer 12 after the development of the patch image may be changed discretely or continuously so as to set an optimal amount of neutralized charges based on a surface potential of each position of wet-type developer 12 after the development as corresponding to the patch image.

Figure 18:
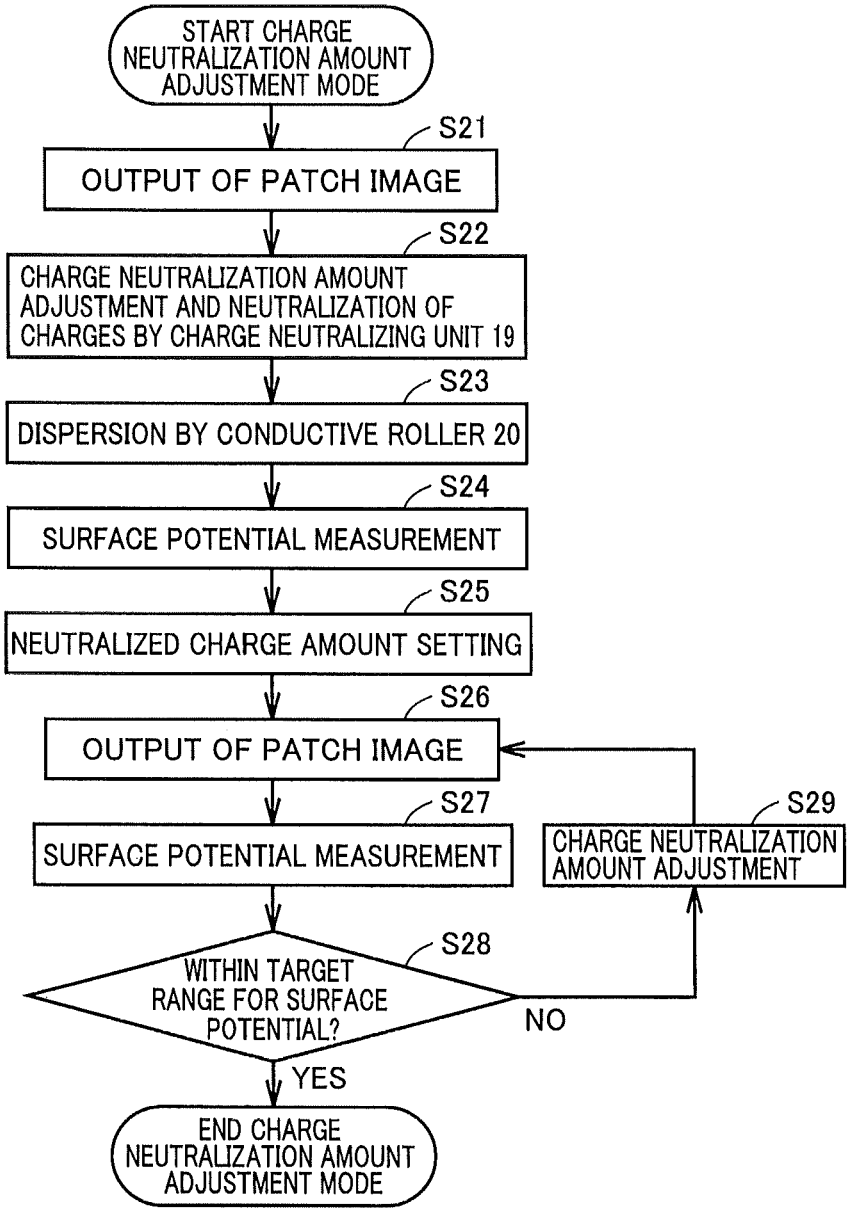
FIG. 18 shows a flow of a modification of the image formation in the wet-type image forming apparatus according to the fifth embodiment of the present invention.

FIG. 18 shows a flowchart of the sequence in the modification. First, a charge neutralization amount adjustment sequence is started. As image formation conditions (the amount of charge, the developing bias, the amount of exposure, and the like), conditions determined in advance and corresponding to a type of sheet or a type of color are employed. When the adjustment sequence is started, first, a patch image for use in the adjustment of the amount of neutralized charges is output and is developed on photoconductor drum 1 (S21). After the patch image is developed on photoconductor drum 1, charges of wet-type developer 12 after the development are neutralized while changing the amount of neutralized charges discretely or continuously (S22).

Next, wet-type developer 12 after the development is subjected to the dispersion by conductive roller 20 (S23), and the surface potential of wet-type developer 12 after the development is measured (S24). On this occasion, the optimal amount of neutralized charges is set based on a surface potential of each region of wet-type developer 12 after the development as corresponding to the position of the patch image. Then, a patch is output again (S26), and when the surface potential of wet-type developer 12 after the development falls within the target range around the developing bias (S28), the adjustment mode is ended. On the other hand, when the surface potential of wet-type developer 12 after the development does not fall within the target range, the amount of neutralized charges is adjusted (S29) and an adjustment patch is output again (S26).

Figure 19:
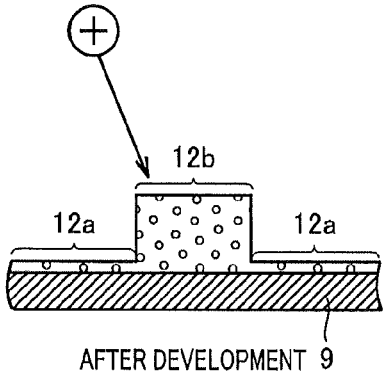
FIG. 19 is a first schematic cross sectional view for illustrating that an optimal amount of neutralized charges is changed depending on a toner image developed on a photoconductor drum.

Moreover, the optimal amount of neutralized charges may be changed also depending on an image pattern developed on photoconductor drum 1. This will be described with reference to FIG. 19 to FIG. 21. Regarding wet-type developer 12 remaining on developer carrier 9 after the development, for a region corresponding to an image portion (black solid) of the toner image developed on photoconductor drum 1, wet-type developer 12 has been transferred onto photoconductor drum 1 so as to develop the electrostatic latent image on photoconductor drum 1. As a result, in region 12*a*, substantially no wet-type developer 12 remains on developer carrier 9 as shown in FIG. 19. On the other hand, for a region corresponding to a background portion (white solid) of the image pattern, wet-type developer 12 has not been transferred onto photoconductor drum 1. As a result, in region 12*b*, wet-type developer 12 remains on developer carrier 9 as shown in FIG. 19.

Figure 20:
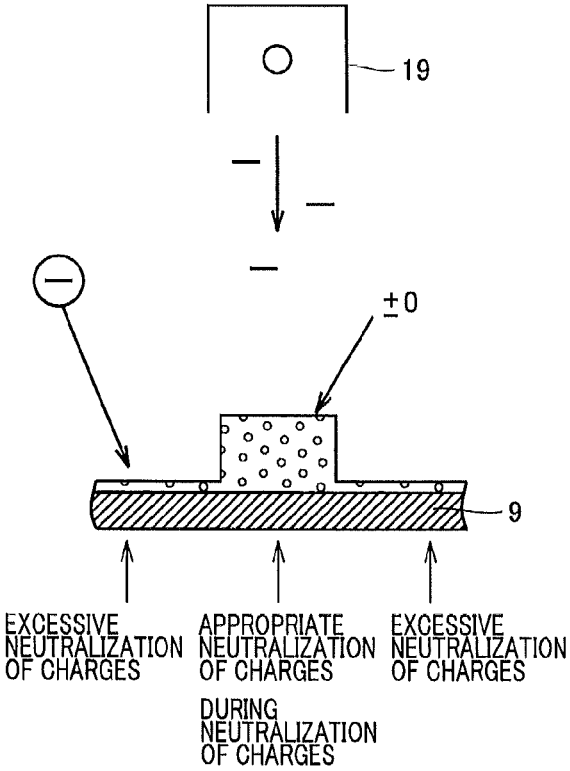
FIG. 20 is a second schematic cross sectional view for illustrating that the optimal amount of neutralized charges is changed depending on the toner image developed on the photoconductor drum.

Referring to FIG. 20, for example, when the optimal amount of neutralized charges is set for region 12*b*, region 12*b* is supplied with substantially the same amount of charges for neutralization as the amount of charges held by region 12*b*. On the other hand, the amount of charges held by region 12*a* is less than that in region 12*b*, so that an excessive amount of charges is neutralized. As such, the optimal charge neutralization output is changed depending on the image pattern developed on photoconductor drum 1.

Figure 21:
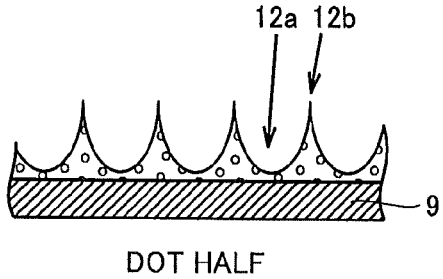
FIG. 21 is a third schematic cross sectional view for illustrating that the optimal amount of neutralized charges is changed depending on the toner image developed on the photoconductor drum.

When the amount of neutralized charges is adjusted based on the patch image developed on photoconductor drum 1 as described above, the adjustment is desirably performed in consideration of this. Specifically, an optimal image pattern for a system is selected for the image pattern of the patch image in the above sequence. In many cases, as shown in FIG. 21, a dot half pattern is suitable. This is due to the following reason. That is, in wet-type developer 12 after the development, a region having a maximum amount of charges in value is region 12*b* and a region having a minimum amount of charges in value is region 12*a*. In a system in which they were mixed with each other, an optimal amount of neutralized charges can be set by setting it at an intermediate value therebetween.

As the control therefor, for example, the control sequence described is performed when starting the wet-type image forming apparatus or is performed with the charge neutralization amount adjustment sequence being provided between images, thereby maintaining the optimal amount of neutralized charges irrespective of various errors. Also during the image formation on photoconductor drum 1, a similar sequence can be performed by forming a patch image on photoconductor drum 1 at a portion out of a range for the image formation such as an axial end portion.

EXAMPLES

Referring to FIG. 22, the following describes verification experiments conducted with regard to each of examples and comparative examples.

For each of comparative example 1 to comparative example 6 shown in FIG. 22, a test device was used which was obtained by employing wet-type developing device 4 according to the first embodiment as its basic configuration with partial configuration modification being made. Specifically, the configuration of wet-type developing device 4 was changed by selecting whether to dispose charge neutralizing unit 19 and the dispersing unit, changing the arrangement of charge neutralizing unit 19 and the dispersing unit, and changing the bias applied to the dispersing unit.

For each of comparative examples 7 and 8, a test device was used which was obtained by employing wet-type developing device 4D according to the second embodiment as its basic configuration with partial configuration modification being made. Specifically, the configuration of wet-type developing device 4D was changed by selecting whether to dispose the charge neutralizing unit and changing the arrangement of charge neutralizing unit 19 and the dispersing unit. For example 1, wet-type developing device 4 according to the first embodiment was used. For example 2, wet-type developing device 4D according to the second embodiment was used.

When the charge neutralizing unit was used, a DC corotron was used, and the amount of charge neutralizing current is set at an intermediate amount of current (0.25 [mA/m]) between an amount of current (0.2 [mA/m]) by which the surface potential of the toner layer after the neutralization of charges becomes zero and an amount of current (0.3 [mA/m]) in the toner charging device.

When the dispersing unit was used, a metal roller made of stainless steel was used apart from a case where a supersonic vibration providing member is used. When the metal roller was used, the rotation speed of the roller was set such that the rotation direction and peripheral speed of the roller are the same as those of developer carrier 9.

The wet-type developing device in each of examples 1 and 2 and comparative examples 1 to 6 is driven continuously for 1 hour, and a state of accumulation of toner particles on removing unit 18 was observed. In doing so, a case where toner particles were accumulated rapidly was determined as "C", a case where toner particles were accumulated gradually was determined as "B", a case where toner particles were not accumulated was determined as "A".

Comparative Example 1

In comparative example 1, the wet-type developing device employed was not provided with both charge neutralizing unit 19 and the dispersing unit, and the wet-type developer after the development was only subjected to the removal by removing unit 18. In this case, the result of accumulation of toner particles was determined as "C".

Comparative Example 2

In comparative example 2, the wet-type developing device employed was not provided with charge neutralizing unit 19, and the wet-type developer after the development was subjected to the dispersion by the dispersing unit and the removal by removing unit 18. The dispersing unit was not fed with a bias and has the same potential as that of developer carrier 9. In this case, the result of accumulation of toner particles was determined as "C".

Comparative Example 3

In comparative example 3, the wet-type developing device employed was not provided with charge neutralizing unit 19, and the wet-type developer after the development was subjected to the dispersion by the dispersing unit and the removal by removing unit 18. The dispersing unit was fed with an AC bias. The AC bias has a sine waveform having a frequency of 10000 Hz and an amplitude of 300 V (Peak-to-valley of 600 V). In this case, the result of accumulation of toner particles was determined as "C".

Comparative Example 4

In comparative example 4, the wet-type developing device employed was not provided with the dispersing unit, and the wet-type developer after the development was subjected to the neutralization of charges by the charge neutralizing unit and the removal by removing unit 18. In this case, the result of accumulation of toner particles was determined as "B".

Comparative Example 5

In comparative example 5, the wet-type developing device employed included charge neutralizing unit 19 and the dispersing unit disposed in this order in the rotation direction of developer carrier 9, and the wet-type developer after the development was subjected to the neutralization of charges by the charge neutralizing unit, the dispersion by the dispersing unit, and the removal by removing unit 18 in this order. The dispersing unit was not fed with a bias and has the same potential as that of developer carrier 9. In this case, the result of accumulation of toner particles was determined as "B".

Comparative Example 6

In comparative example 6, the wet-type developing device employed included the dispersing unit and charge neutralizing unit 19 disposed in this order in the rotation direction of developer carrier 9, and the wet-type developer after the development was subjected to the dispersion by the dispersing unit, the neutralization of charges by the charge neutralizing unit, and the removal by removing unit 18 in this order. The dispersing unit was fed with an AC bias. The AC bias has a sine waveform having a frequency of 10000 Hz and an amplitude of 300 V (Peak-to-valley of 600 V). In this case, the result of accumulation of toner particles was determined as "B".

Comparative Example 7

In comparative example 7, the wet-type developing device employed was not provided with the dispersing unit, and the wet-type developer after the development was subjected to the dispersion by the dispersing unit and the removal by removing unit 18. As the dispersing unit, a supersonic vibration providing member was used. In this case, the result of accumulation of toner particles was determined as "C".

Comparative Example 8

In comparative example 8, the wet-type developing device employed included the dispersing unit and charge neutralizing unit 19 disposed in this order in the rotation direction of developer carrier 9, and the wet-type developer after the development was subjected to the dispersion by the dispersing unit, the neutralization of charges by the charge neutralizing unit, and the removal by removing unit 18 in this order. As the dispersing unit, a supersonic vibration providing member was used. In this case, the result of accumulation of toner particles was determined as "B".

Example 1

In example 1, the wet-type developing device employed included charge neutralizing unit 19 and the dispersing unit disposed in this order in the rotation direction of developer carrier 9, and the wet-type developer after the development was subjected to the neutralization of charges by the charge neutralizing unit, the dispersion by the dispersing unit, and the removal by removing unit 18 in this order. The dispersing unit was fed with an AC bias. The AC bias has a sine waveform having a frequency of 10000 Hz and an amplitude of 300 V (Peak-to-valley of 600 V). In this case, the result of accumulation of toner particles was determined as "A".

Example 2

In example 2, the wet-type developing device employed included charge neutralizing unit 19 and the dispersing unit disposed in this order in the rotation direction of developer carrier 9, and the wet-type developer after the development was subjected to the neutralization of charges by the charge neutralizing unit, the dispersion by the dispersing unit, and the removal by removing unit 18 in this order. As the dispersing unit, a supersonic vibration providing member was used. In this case, the result of accumulation of toner particles was determined as "A".

(Experimental Results and Review)

In comparative example 1, both the charge neutralizing unit and the dispersing unit were not disposed, so that the toner particles contained in the wet-type developer were strongly bound to developer carrier 9 during the removal by removing unit 18. For this reason, it is considered that the toner particles were accumulated rapidly.

In comparative example 2, the dispersing unit was disposed but the charge neutralizing unit was not disposed and the dispersing unit was not fed with a bias. For this reason, it is considered that the electrostatic binding force acting on the toner particles to be attracted to developer carrier 9 could not be canceled and a sufficient dispersing effect could not be obtained, with the result that the toner particles were accumulated rapidly.

In comparative example 3, the dispersing unit was disposed and fed with the AC bias but the charge neutralizing unit was not disposed, so that the electrostatic binding force of developer carrier 9 acting on the toner particles was not sufficiently canceled during the dispersion. Accordingly, even after a part of toner particles were dispersed by passing by the dispersing unit, toner particles having the same amount of charges as that at the time of development were adhered to surface 9*a* of developer carrier 9 again before the removal by removing unit 18. For this reason, it is considered that also during the removal by removing unit 18, the toner particles contained in the wet-type developer were strongly bound to developer carrier 9, with the result that the toner particles were accumulated rapidly.

In comparative example 4, the charge neutralizing unit was disposed to thereby reduce the electrostatic binding force of developer carrier 9 acting on the toner particles as compared with comparative examples 1 to 3 during the removal by removing unit 18, but the dispersing unit was not disposed, so that the toner particles could not be sufficiently dispersed in the carrier liquid. For this reason, it is considered that the toner particles were accumulated gradually.

In comparative example 5, both the charge neutralizing unit and the dispersing unit were disposed, but the dispersing unit was not fed with an AC bias, so that a sufficient dispersing effect was not obtained, thus failing to disperse the toner particles sufficiently in the carrier liquid. For this reason, it is considered that the toner particles were accumulated gradually.

In comparative example 6, both the charge neutralizing unit and the dispersing unit were disposed and the dispersing unit was fed with an AC bias, but the dispersion by the dispersing unit was performed prior to the neutralization of charges by the charge neutralizing unit. Accordingly, even after the toner particles were dispersed by passing by the dispersing unit, toner particles having the same amount of charges as that at the time of development were adhered to surface 9*a* of developer carrier 9 again by electrostatic force before the neutralization of charges is performed by the charge neutralizing unit.

Due to the neutralization of charges with the toner particles being adhered thereto again, the electrostatic binding force acting on the toner particles to be attracted to developer carrier 9 was reduced but the electrostatic binding force could not be canceled completely. For this reason, it is considered that the toner particles were accumulated gradually.

In comparative example 7, the toner particles were dispersed by the supersonic vibration from the dispersing unit but the charge neutralizing unit is not disposed, so that the electrostatic binding force of developer carrier 9 acting on the toner particles was not sufficiently canceled during the dispersion. For this reason, it is considered that a phenomenon almost the same as that in comparative example 3 took place, with the result that almost the same result as that in comparative example 3 was obtained.

In comparative example 8, both the charge neutralizing unit and the dispersing unit were disposed and the toner particles were dispersed by the supersonic vibration from the dispersing unit, but the dispersion by the dispersing unit was performed prior to the neutralization of charges by the charge neutralizing unit. For this reason, it is considered that a phenomenon almost the same as that in comparative example 6 took place, with the result that almost the same result as that in comparative example 6 was obtained.

In example 1, the charges of the toner particles after the development were canceled on the average by the charge neutralizing unit, and then the AC electric field was formed by the dispersing unit to disperse the toner particles, thereby preventing the toner particles from being adhered to surface 9*a* of developer carrier 9 again before the removal by removing unit 18. For this reason, it is considered that the accumulation of toner particles did not take place and a significant effect of improvement was obtained in example 1 as compared with comparative examples 1 to 8.

In example 2, the charges of the toner particles after the development were canceled on the average by the charge neutralizing unit, and then the supersonic vibration was provided by the dispersing unit to disperse the toner particles, thereby preventing the toner particles from being adhered to surface 9*a* of developer carrier 9 again before the removal by removing unit 18. For this reason, it is considered that the accumulation of toner particles did not take place and a significant effect of improvement was obtained in example 2 as compared with comparative examples 1 to 8.

In the manner described above, by dispersing the toner particles in the carrier liquid with the charges of the toner particles after the development being canceled by the charge neutralizing unit, the toner particles can be prevented from being adhered to developer carrier 9 again before the removal by removing unit 18. Hence, it can be said that it was proved empirically that the toner particles contained in wet-type developer 12 remaining on developer carrier 9 after the development were suppressed from being accumulated on removing unit 18.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet-type developing device comprising:

a developer carrier for carrying a wet-type developer, which contains a charged toner particle and carrier liquid, and supplying said wet-type developer to an image carrier on which an electrostatic latent image is formed;

a charge neutralizing unit for neutralizing a charge of said toner particle contained in said wet-type developer remaining on said developer carrier after supplying said wet-type developer to said image carrier;

a dispersing unit for dispersing said toner particle in said carrier liquid by acting on said toner particle contained in said wet-type developer neutralized in charge by said charge neutralizing unit;

a removing unit for removing, from said developer carrier, said wet-type developer containing said toner particle dispersed by said dispersing unit;

a surface potential measuring unit, disposed at a downstream side relative to said dispersing unit and an upstream side relative to said removing unit in a rotation direction of said developer carrier, for measuring a surface potential on said developer carrier; and a control unit for controlling an amount of charge neutralized by said charge neutralizing unit, wherein said control unit controls the amount of charge neutralized by said charge neutralizing unit based on the surface potential on said developer carrier measured by said surface potential measuring unit.

2. The wet-type developing device according to claim 1, wherein said charge neutralizing unit neutralizes the charge such that a polarity of a surface potential of a toner layer formed by a plurality of said toner particles adsorbed on a surface of said developer carrier becomes opposite to a normal charge polarity of said toner particle.

3. The wet-type developing device according to claim 1, further comprising a charging unit for charging said toner particle before said developer carrier supplies said wet-type developer to said image carrier, wherein an amount of neutralized charge of said toner particle by said charge neutralizing unit is equal to or less than an amount of charge provided to said toner particle by said charging unit.

4. The wet-type developing device according to claim 1, wherein said dispersing unit includes a conductive member disposed to face said developer carrier such that an AC bias is applied between said developer carrier and said conductive member.

5. The wet-type developing device according to claim 4, wherein said conductive member is disposed in contact with said wet-type developer neutralized in charge by said charge neutralizing unit.

6. The wet-type developing device according to claim 4, wherein the AC bias applied between said conductive member and said developer carrier has an average potential as large as a potential of said developer carrier.

7. The wet-type developing device according to claim 4, wherein said conductive member is disposed to be spaced away from said wet-type developer so as not to make contact with said wet-type developer neutralized in charge by said charge neutralizing unit.

8. The wet-type developing device according to claim 7, wherein the AC bias applied between said conductive member and said developer carrier has an average potential that attracts said toner particle from the developer carrier side to the conductive member side.

9. The wet-type developing device according to claim 1, wherein said dispersing unit includes a vibration providing member for providing ultrasonic vibration to said toner particle contained in said wet-type developer neutralized in charge by said charge neutralizing unit.

10. The wet-type developing device according to claim 1, wherein said dispersing unit includes a brush member for slidably making contact with said developer carrier so as to disperse said toner particle contained in said wet-type developer neutralized in charge by said charge neutralizing unit.

11. The wet-type developing device according to claim 1, further comprising a unit for applying a developing bias to said developer carrier, wherein said control unit controls the amount of charge neutralized by said charge neutralizing unit such that a value of the surface potential on said developer carrier becomes close to the developing bias.

12. The wet-type developing device according to claim 1, wherein said control unit controls the amount of charge neutralized by said charge neutralizing unit, in a start sequence.

13. A wet-type image forming apparatus comprising:

a wet-type developing device including a developer carrier for carrying a wet-type developer, which contains a charged toner particle and carrier liquid, and supplying said wet-type developer to an image carrier on which an electrostatic latent image is formed, a charge neutralizing unit for neutralizing a charge of said toner particle contained in said wet-type developer remaining on said developer carrier after supplying said wet-type developer to said image carrier, a dispersing unit for dispersing said toner particle in said carrier liquid by acting on said toner particle contained in said wet-type developer neutralized in charge by said charge neutralizing unit, and a removing unit for removing, from said developer carrier, said wet-type developer containing said toner particle dispersed by said dispersing unit;

a surface potential measuring unit, disposed at a downstream side relative to said dispersing unit and an upstream side relative to said removing unit in a rotation direction of said developer carrier, for measuring a surface potential on said developer carrier; and a control unit for controlling an amount of charge neutralized by said charge neutralizing unit, wherein said control unit controls the amount of charge neutralized by said charge neutralizing unit based on the surface potential on said developer carrier measured by said surface potential measuring unit; and a transfer unit for transferring, to a recording medium, a toner image formed on said image carrier by developing said electrostatic latent image by said wet-type developer.

14. The wet-type image forming apparatus according to claim 13, wherein a patch image for controlling an amount of charge neutralized by said charge neutralizing unit is formed on said image carrier, and said control unit controls the amount of charge neutralized by said charge neutralizing unit based on a surface potential on said developer carrier after developing said patch image onto said image carrier.

15. The wet-type image forming apparatus according to claim 14, wherein said patch image is formed in a region between a plurality of said toner images.

16. The wet-type image forming apparatus according to claim 14, wherein said patch image is formed in a region out of a range of said toner image.

17. The wet-type image forming apparatus according to claim 14, wherein said patch image is a dot half pattern.

* * * * *